US011024246B2

(12) United States Patent
Haga

(10) Patent No.: US 11,024,246 B2
(45) Date of Patent: Jun. 1, 2021

(54) DISPLAY APPARATUS AND METHOD FOR DRIVING DISPLAY PANEL WITH SCANNING LINE CLOCK SIGNAL OR SCANNING LINE SIGNAL CORRECTING UNIT

(71) Applicant: SAKAI DISPLAY PRODUCTS CORPORATION, Sakai (JP)

(72) Inventor: Shuhei Haga, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 0 days.

(21) Appl. No.: 16/671,671

(22) Filed: Nov. 1, 2019

(65) Prior Publication Data

US 2020/0152149 A1 May 14, 2020

Related U.S. Application Data

(60) Provisional application No. 62/758,267, filed on Nov. 9, 2018.

(51) Int. Cl.
*G09G 3/36* (2006.01)
*G09G 3/3266* (2016.01)

(52) U.S. Cl.
CPC ..... *G09G 3/3677* (2013.01); *G09G 3/3266* (2013.01); *G09G 3/3659* (2013.01); *G09G 2310/062* (2013.01); *G09G 2310/08* (2013.01); *G09G 2320/0223* (2013.01); *G09G 2320/0233* (2013.01)

(58) Field of Classification Search
CPC .. G09G 3/3659; G09G 3/3266; G09G 3/3677; G09G 2310/062; G09G 2310/0267; G09G 2330/12
See application file for complete search history.

(56) References Cited

U.S. PATENT DOCUMENTS 4,649,383 A * 3/1987 Takeda ..... G09G 3/3648 345/208
8,089,598 B2 * 1/2012 Kim ..... G09G 3/3648 349/149
2005/0062710 A1 * 3/2005 Kasai ..... G09G 3/3225 345/99

(Continued)

FOREIGN PATENT DOCUMENTS

CN 105913818 A * 8/2016 ..... G09G 3/3674
JP S59-123884 A 7/1984

*Primary Examiner* — Darlene M Ritchie
(74) *Attorney, Agent, or Firm* — ScienBiziP, P.C.

(57) ABSTRACT

A display apparatus is disclosed. The display apparatus according to one embodiment comprises: a display panel comprising a plurality of pixels arranged in a matrix, a plurality of scanning lines, and a plurality of data lines; a timing control unit to generate a scanning line clock signal in which a level transition is repeated; a plurality of scanning line drive units to successively output a scanning line signal based on the scanning line clock signal to the scanning lines; and a signal correcting unit to correct either one of the scanning line clock signal and the scanning line signal such that time differences between a timing of one level transition of the scanning line clock signal and a timing of a level transition of the scanning line signal based on the one level transition substantially match among the scanning line signals output by respective scanning line drive units.

12 Claims, 9 Drawing Sheets

(56) References Cited

U.S. PATENT DOCUMENTS

| | | | | |
|---|---|---|---|---|
| 2007/0188423 | A1* | 8/2007 | Kasai | G09G 3/3225 345/76 |
| 2011/0102384 | A1* | 5/2011 | Huang | G09G 3/3685 345/204 |
| 2014/0132576 | A1* | 5/2014 | Park | G09G 3/20 345/204 |
| 2014/0313108 | A1* | 10/2014 | Kim | G09G 3/3266 345/76 |
| 2015/0062471 | A1* | 3/2015 | Sung | G02F 1/1362 349/33 |
| 2015/0302816 | A1* | 10/2015 | Won | G09G 3/3681 345/87 |
| 2015/0379951 | A1* | 12/2015 | Zeng | G09G 3/3681 345/92 |
| 2016/0266700 | A1* | 9/2016 | Ji | G09G 3/3674 |
| 2016/0335972 | A1* | 11/2016 | Lee | G09G 3/3677 |
| 2017/0270890 | A1* | 9/2017 | Chung | G09G 5/00 |
| 2018/0196295 | A1* | 7/2018 | Xing | G09G 3/3677 |

* cited by examiner

DISPLAY APPARATUS AND METHOD FOR DRIVING DISPLAY PANEL WITH SCANNING LINE CLOCK SIGNAL OR SCANNING LINE SIGNAL CORRECTING UNIT

CROSS-REFERENCE TO RELATED APPLICATIONS

This application claims priority to and the benefit of priority of U.S. Provisional Application No. 62/758,267, filed on Nov. 9, 2018 the entire contents of which are incorporated herein by reference.

BACKGROUND

Technical Field

The present disclosure relates to a display apparatus and a method for driving display panel.

Description of Related Art

An active matrix-type driving method is often used in a display apparatus comprising a display panel such as a liquid crystal display panel or an organic-EL display panel. In the display panel using the active matrix-type driving method, a switching element (for example, a thin-film transistor (TFT)) is provided at each one of a plurality of pixels arranged in a matrix. The display panel comprises a plurality of scanning lines provided for each row of pixels and a plurality of data lines provided for each column of pixels, the pixels being arranged in a matrix. Each scanning line is connected to the gate of each one of the plurality of TFTs arranged on each row. A signal level (below also called merely "a level") of a scanning line signal applied to the scanning line on each row is successively caused to transition from a low level to a high level. For example, a TFT connected to a scanning line to which a high-level signal is applied will be turned on. On the other hand, each data line is connected to the source (or the drain) of each one of the plurality of TFTs arranged on each column. A data line signal having a level (for example, an electric potential) according to a gray scale of a pixel selected by the scanning line signal (a pixel comprising a TFT to be turned on) is applied to each of the data lines.

For example, in the liquid crystal display panel, based on the electric potential of the data line signal applied to the TFT being turned on, a voltage is applied to the liquid crystal layer of the pixel comprising the above-mentioned TFT. Then, the capacitance of the liquid crystal layer (and the auxiliary capacitance provided in parallel with the liquid crystal layer) are charged or discharged with the voltage applied. Thus, even after the TFT switches off, the voltage applied to the liquid crystal layer is held over the display period of one still image (frame). Each of the pixels causes light to be transmitted therethrough at the transmittance based on the voltage held.

In the display apparatus such as a liquid crystal display apparatus, it is advantageous to increase, from the point of view of improving the definition of image and the smoothness of video, the number of pixels and the number of images displayed for each unit time (below also called merely "a frame rate"). However, with an increase in the number of pixels and/or the frame rate, the time allowed to set each of the pixels to a desired luminance becomes shorter. For example, the time allowed to turn on TFTs in the respective pixels arranged on one row in a matrix arrangement becomes shorter. Therefore, a sophisticated control of the scanning line signal is being more required than before such that the voltage based on the data line signal is appropriately applied to and held in the liquid crystal layer in a short time in the liquid crystal display panel, for example.

The scanning line signal is output to each scanning line from each one of a plurality of scanning line drive circuits provided in the display panel such as the liquid crystal display panel. The plurality of scanning line drive circuits is preferably integrated for each given number thereof. For example, they are embodied as a plurality of scanning line drive units, each one of which comprises a semiconductor integrated circuit comprising a given number of scanning line drive circuits. Each scanning line drive circuit generates a scanning line signal based on a scanning line clock signal indicating the timing to switch a TFT to be turned on in a plurality of pixels arranged in a matrix, and then outputs the generated scanning line signal. The scanning clock signal is generated by a timing control unit to generate a signal to be input into the display panel, the generated scanning clock signal is input into each one of the plurality of scanning line drive units.

However, in the waveform of the scanning line clock signal, distortion can occur between when it is generated at the timing control unit and when it is input into each one of the plurality of scanning line drive units. For example, the plurality of scanning line drive units is arranged along one side of the outer edge of the display panel whose front shape is rectangular. In that case, the scanning line clock signal is input into each of the scanning line drive units via a wiring formed on the display panel along the arrangement direction of the plurality of scanning line drive units. The wiring formed on the display panel can have a certain electrical resistance. Therefore, distortion according to the propagation distance can occur in the waveform of the scanning line clock signal input at one end of the wiring and propagating through the wiring, for example. Then, the scanning line clock signals, each having the waveform so distorted as to be mutually different, can be input into the respective scanning line drive units. Under such a condition, as described in detail later, the scanning line signal causing the level thereof to transition at the timing as intended is possibly not necessarily output from all of the scanning line drive units.

Moreover, the input properties for the scanning line clock signals can also differ because of variations in manufacturing conditions among each of the scanning line drive units and a drop in power supply voltage caused by wirings, etc. In such a case as well, a scanning line signal causing the level thereof to transition at the timing as intended is possibly not necessarily output from all of the scanning line drive units, regardless of whether the waveforms of respective scanning clock signals input into respective ones of the plurality of scanning line drive units are the same or not.

If the scanning line signal causing the level thereof to transition at the timing as intended is not output from each one of the scanning line drive units, display unevenness can occur between pixels driven by mutually different scanning line drive units.

SUMMARY

Then, according to one Embodiment of the present disclosure, a display panel comprising a plurality of pixels arranged in a matrix, the plurality of pixels making up a display area, a plurality of scanning lines connected to a group of pixels arranged in a row direction of the plurality of pixels, and a plurality of data lines connected to a group of pixels arranged in a column direction of the plurality of pixels; a timing control unit to generate a scanning line clock signal in which a level transition is repeated from a first signal level to a second signal level at a period corresponding to one scanning period of the display panel; a plurality of scanning line drive units arranged along a part of the outer edge of the display area, wherein each one of the plurality of scanning line drive units successively outputs a scanning line signal to any two or more scanning lines in the plurality of scanning lines, the scanning line signal being a signal to select a group of pixels arranged in the row direction and being based on the scanning line clock signal; a data line drive unit to output, to the plurality of data lines, a data line signal for supplying a desired voltage to a group of pixels arranged in the row direction and selected by the scanning line signal; and a signal correcting unit to correct either one of the scanning line clock signal generated by the timing control unit, and the scanning line signal to be output to at least one scanning line in the plurality of scanning lines such that time differences between a timing of one level transition of the scanning line clock signal and a timing of a level transition of the scanning line signal based on the one level transition substantially match one another among the scanning line signals output by respective ones of the plurality of scanning line drive units.

A method for driving display panel according to another Embodiment of the present disclosure comprises: generating a scanning line clock signal in which a signal level transition is repeated at a period corresponding to one scanning period of a display panel, the display panel comprising a plurality of pixels arranged in a matrix, a plurality of scanning lines, and a plurality of data lines, the plurality of scanning lines and the plurality of data lines being connected to the plurality of pixels; generating a scanning line signal to select a group of pixels arranged in a row direction of the plurality of pixels, based on the scanning line clock signal, at each of a plurality of scanning line drive units connected to any two or more scanning lines in the plurality of scanning lines; successively outputting the scanning line signal to the plurality of scanning lines from the plurality of scanning line drive units; applying, to the plurality of data lines, a data line signal for supplying a desired voltage to each of the plurality of pixels; and correcting either one of the scanning line clock signal generated, and the scanning line signal to be output to at least one scanning line in the plurality of scanning lines such that time differences between a timing of one level transition of the scanning line clock signal and a timing of a level transition of the scanning line signal based on the one level transition substantially match one another among the scanning line signals output by respective ones of the plurality of scanning line drive units.

According to the display apparatus and the method for driving display panel according to Embodiments of the present disclosure, it is possible to suppress display unevenness between pixels driven by mutually different scanning line drive units.

DETAILED DESCRIPTION

Below, a display apparatus and a method for driving display panel according to Embodiments of the present disclosure will be described with reference to the drawings. The display apparatus and the method for driving display panel according to the present disclosure are not to be construed to be limited to the description of the Embodiments to be explained below or of each of the drawings to be referred to.

Display Apparatus

Figure 1:
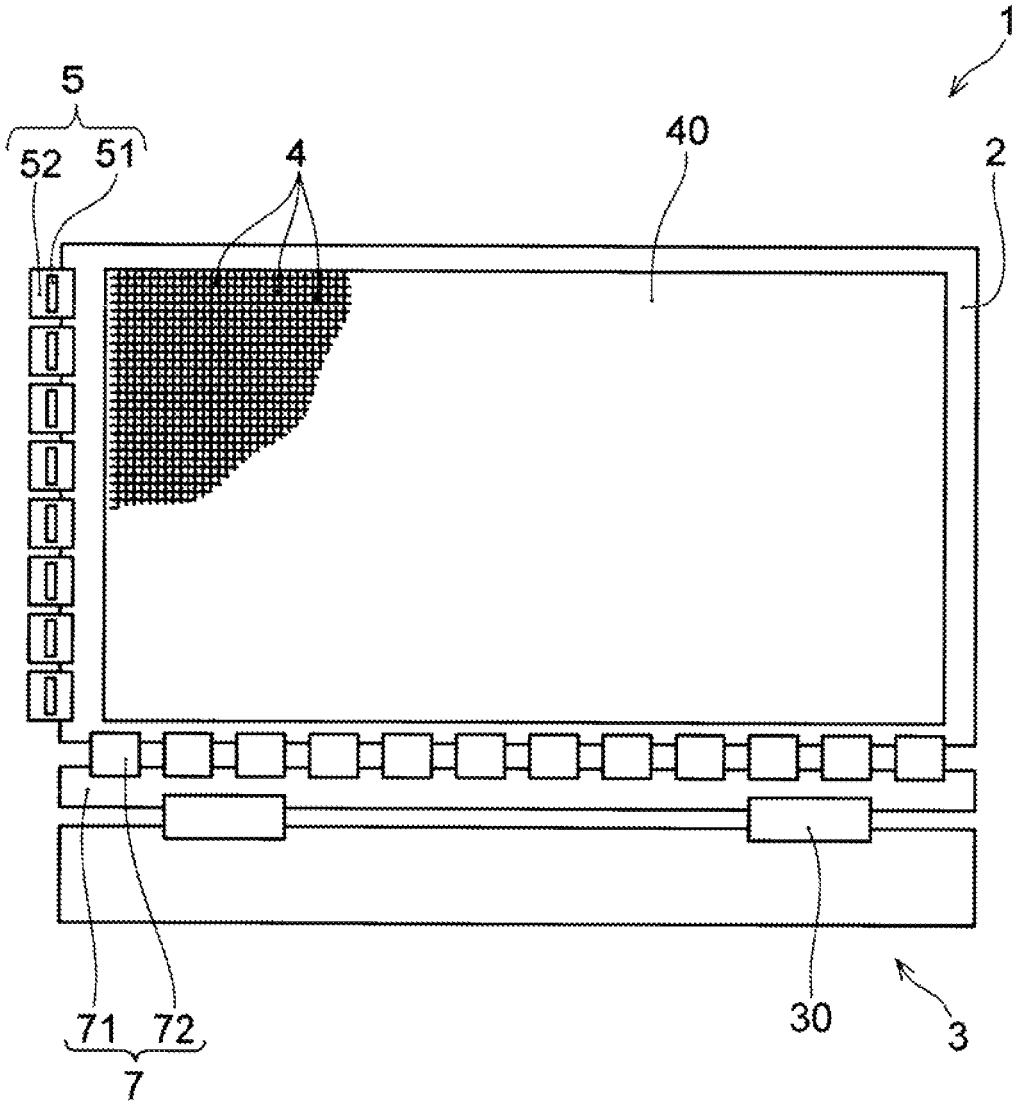
FIG. 1 schematically shows a display apparatus according to one Embodiment of the present disclosure.
Figure 2:
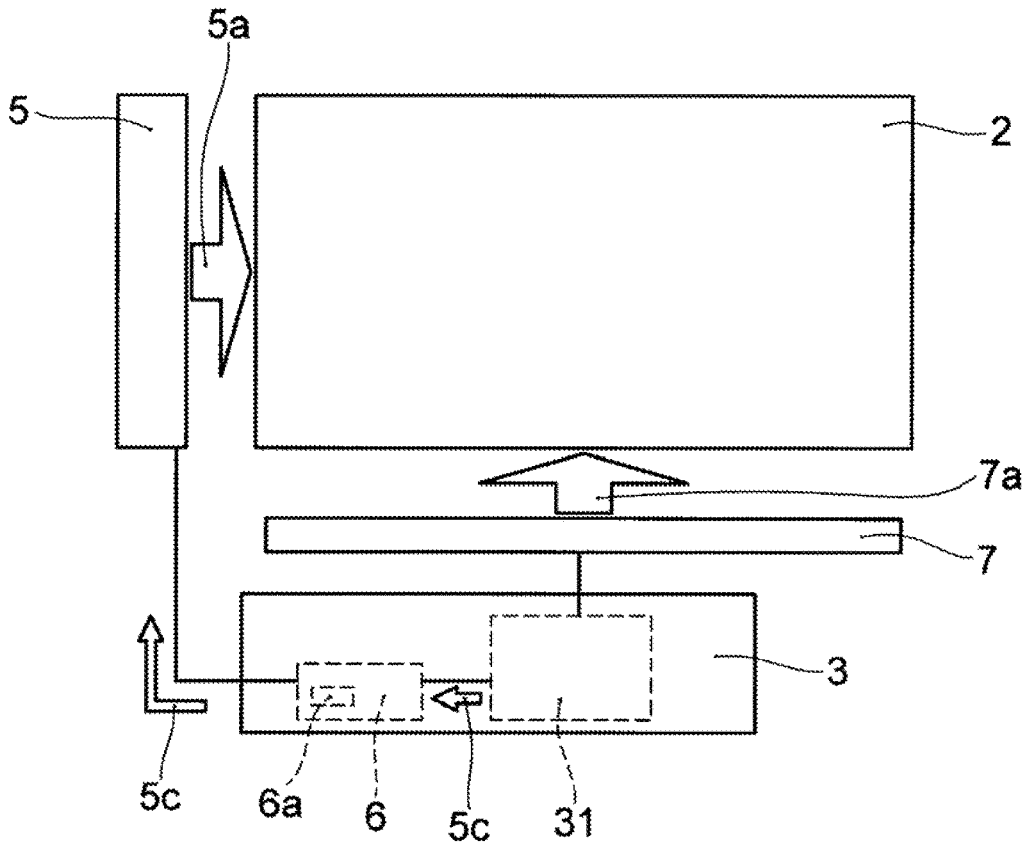
FIG. 2 shows some constituting elements of the display apparatus according to one Embodiment of the present disclosure in a functional block diagram format.

FIG. 1 schematically shows a display apparatus 1 according to one Embodiment of the present disclosure. FIG. 2 shows some constituting elements of the display apparatus 1 in a block diagram format. Moreover, FIG. 3 shows a pixel circuit 4*a* equipped in each one of a plurality of pixels 4 provided in the display apparatus 1.

Figure 3:
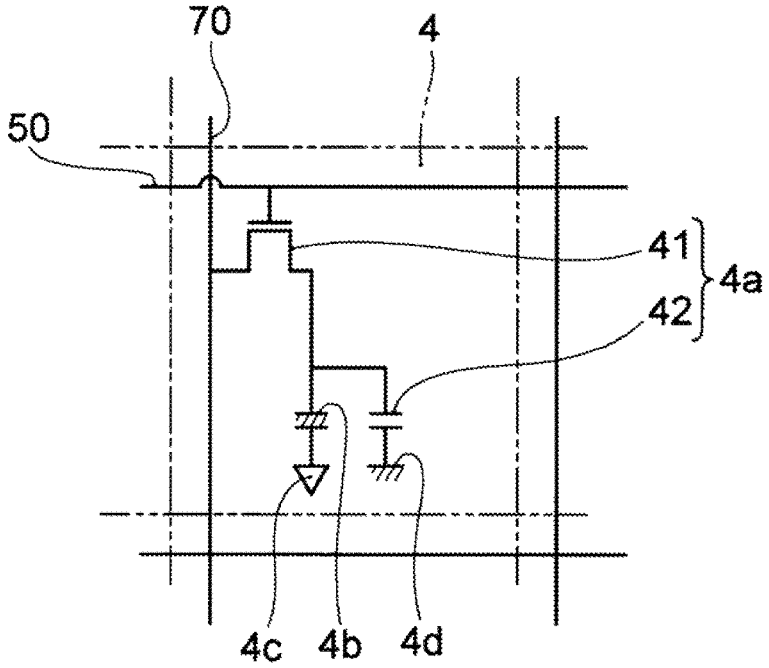
FIG. 3 shows an exemplary pixel circuit in the display apparatus according to one Embodiment of the present disclosure.

As shown in FIGS. 1 to 3, the display apparatus 1 comprises: a display panel 2 comprising the plurality of pixels 4 arranged in a matrix, the plurality of pixels 4 making up a display area 40; a timing control unit 3 to generate and control a signal to be input into the display panel 2; scanning line drive units 5 to supply the pixels 4 with a scanning line signal 5*a* which selects a group of pixels 4 arranged in the row direction; a data line drive unit 7; and a signal correcting unit 6. In the present Embodiment, the signal correcting unit 6 is included in the timing control unit 3. The display panel 2 comprises, together with the plurality of pixels 4, a plurality of scanning lines 50 connected to a group of pixels 4 arranged in the row direction of the plurality of pixels 4; and a plurality of data lines 70 connected to a group of pixels 4 arranged in a column direction of the plurality of pixels 4. The data line drive unit 7 outputs a data line signal 7*a* to the plurality of data lines 70. The data line signal 7*a* supplies a desired voltage (a voltage according to a gray scale value indicated by video data) to the group of pixels 4 arranged in the row direction and selected by the scanning line signal 5*a*.

The data line signal 7*a* is generated at the data line drive unit 7 based on a signal to be sent from the timing control unit 3 and causes the level thereof to transition at the timing according to a display image. The timing control unit 3 generates a scanning line clock signal 5*c* in which a level transition is repeated from a first signal level to a second signal level at a period corresponding to one scanning period of the display panel 2. In the example in FIG. 2, at a clock generating unit 31, the scanning line clock signal 5*c* is generated based on a synchronization signal sent from a host system (not shown) of the display apparatus 1.

In FIG. 2, the scanning line drive unit 5 is shown in one block, however, a plurality of scanning line drive unit 5 can be provided as shown in FIG. 1. Each one of the plurality of scanning line drive units 5 successively outputs the scanning line signal 5*a*, being a signal to select the group of pixels 4 arranged in the row direction and being based on the scanning line clock signal 5*c*, to any two or more scanning lines 50 in the plurality of scanning lines 50. While the display apparatus 1 in the example in FIG. 1 comprises a total of eight of the scanning line drive units 5, the number of scanning line drive units 5 is construed to be not particularly limited, so that the number can be greater or less than eight. The plurality of scanning line drive units 5 are arranged along a part of the outer edge of the display area 40. The display panel 2 and the display area 40 in the example in FIG. 1 has a rectangular front shape, and the plurality of scanning line drive units 5 are arranged at the edge of the display panel 3 to be along one side of the display area 40. Each one of the plurality of scanning line drive units 5 comprises a scanning line drive circuit 51 to output, based on the scanning line clock signal 5*c*, the scanning line signal 5*a* supplied to the plurality of pixels 4.

Figure 5A:
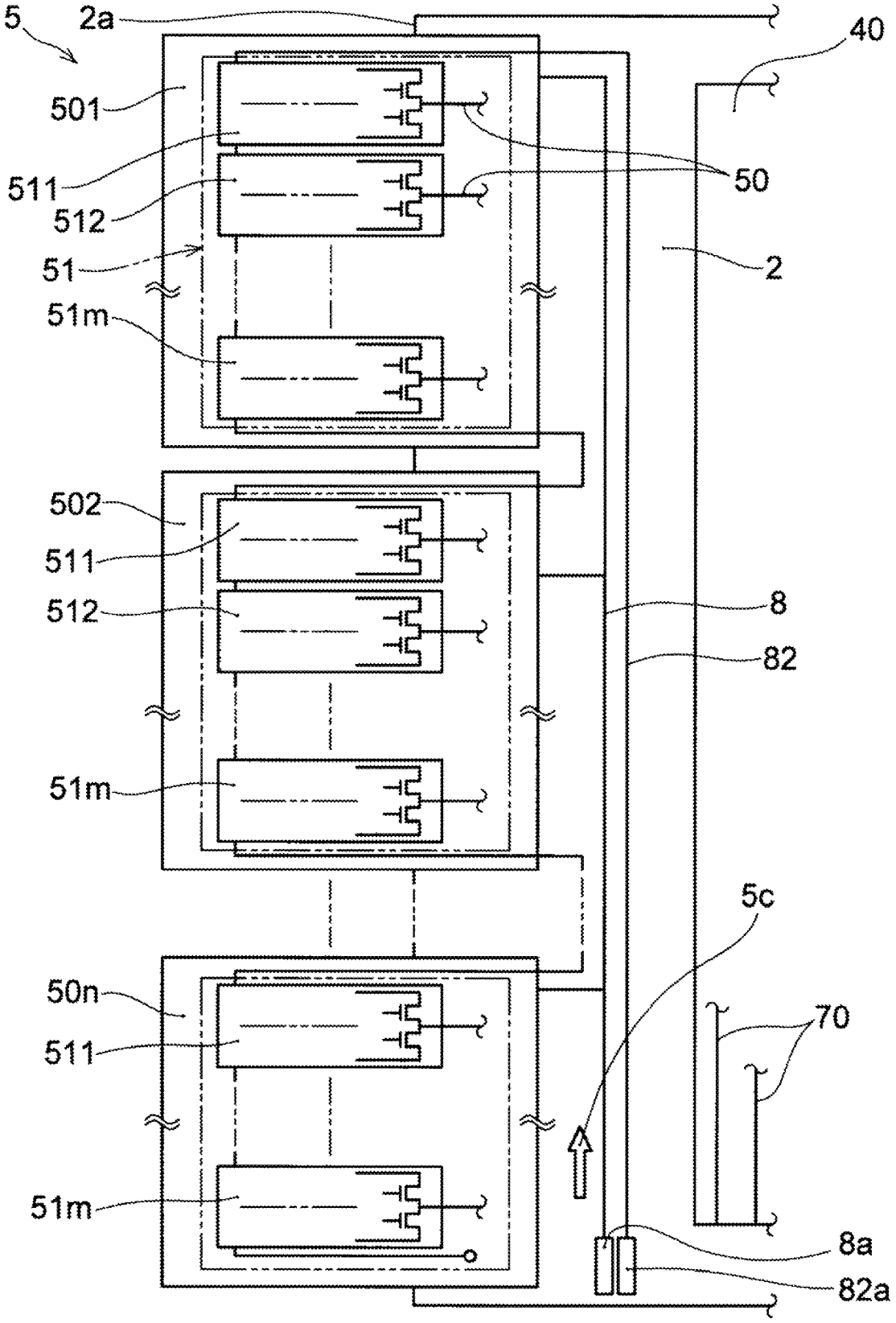
FIG. 5A shows one example of a plurality of scanning line drive units in the display apparatus according to one Embodiment of the present disclosure.

The scanning line drive circuit 51 is drawn collectively as one in each of the scanning line drive units 5 in FIG. 1. However, in practice, as shown in FIG. 5A to be referred to later, multiple scanning line drive circuits 51, the number of which is in accordance with the number of scanning lines 50 connected to each of the scanning line drive units 5, are provided. Each scanning line drive circuit 51 comprises an amplifier circuit and a register circuit, for example. The multiple scanning line drive circuits 51 preferably are integrated into one semiconductor integrated circuit (IC) device for each of the scanning line drive units 5. A general-purpose or user-specific scanning line driver IC can be used as a plurality of scanning line drive circuits 51 provided in one of the scanning line drive units 5.

In the example in FIG. 1, each one of the plurality of scanning line drive units 5 comprises a carrier substrate 52, on which the scanning line drive circuits 51 are mounted. Preferably, a flexible wiring board is used as the carrier substrate 52. The carrier substrate 52 is connected to the display panel 2 using an anisotropic conductive film (not shown), for example, and output terminals of the plurality of scanning line drive circuits 51 are electrically connected, via a wiring pattern (not shown) on the carrier substrate 52, to the scanning lines 50, respectively, the scanning lines 50 being on the display panel 2 (see FIG. 5A). Individual scanning line drive units 5 can be made up of only the plurality of scanning line drive circuits 51, which can be mounted on a surface of the display panel 2, for example, and an output end of the scanning line drive circuits 51 can be connected to the scanning lines 50.

The data line drive unit 7, in the example in FIG. 1, comprises a rigid substrate (a source substrate) 71 comprising a suitable wiring pattern (not shown) and a plurality of flexible substrates 72 connecting the rigid substrate 71 and the display panel 2. Moreover, the data line drive unit 7 comprises, on the rigid substrate 71 or on each of the flexible substrates 72, a data line signal generating circuit (not shown) to generate the data line signal 7*a* based on a data line clock signal, a luminance signal, a gray scale voltage, and a synchronization signal to be sent from the timing control unit 5. The data line signal generating circuit is connected to the data line 70 (see FIG. 3). The data line signal generating circuit can be integrated into the semiconductor integrated circuit device.

The timing control unit 3 is realized as a module substrate (icon substrate) comprising a wiring board as well as main components, such as an application-specific IC (ASIC) or a dedicated IC, and peripheral components of the main component (not shown) that are mounted on a surface of the wiring board, for example. The previously-described clock generating unit 31 and signal correcting unit 6 can be formed using an internal circuit of the main components such as the ASIC. In the timing control unit 3, the scanning line clock signal 5*c*, a data line clock signal, a luminance signal (not shown), etc., are generated in a timely manner based on various control signals and video data, etc., sent from the host system (not shown). These signals are sent to the scanning line drive unit 5 or the data line drive unit 7.

In the example in FIG. 1, the timing control unit 3 is connected to the data line drive unit 7 by a connecting wiring board 30 comprising a suitable wiring pattern, the connecting wiring board 30 preferably being flexible. The scanning line clock signal 5*c* is supplied to each one of the plurality of scanning line drive units 5 via the data line drive unit 7 and the display panel 2.

While the display panel 2 is not particularly construed to be limited as long as it is a display panel comprising pixels arranged in a matrix, a liquid crystal display panel or an organic-EL display panel is particularly exemplified as the display panel 2 of the display apparatus 1. FIGS. 1 to 3 show an example in which the display apparatus 1 is a liquid crystal display apparatus. Thus, the pixel circuit 4*a*, along with a liquid crystal layer 4*b*, is shown in FIG. 3 using an electrical symbol representing an electrostatic capacitance. Even in the explanations below, the display apparatus 1 of the present Embodiment is explained with the display panel 2 as the liquid crystal display panel.

The scanning lines 50 provided in the display panel 2 are connected to one scanning line drive unit 5 for each given number. The scanning line 50 in the number of 135, 270, 320, 480, or 540, for example, can be connected to one scanning drive unit 5.

As shown in FIG. 3, the pixel circuit 4*a* is provided in each of the plurality of pixels 4. The pixel circuit 4*a* comprises a TFT 41 and an auxiliary capacitance 42. The gate of the TFT 41 is connected to the scanning line 50. One of the source and the drain of the TFT 41 is connected to the data line 70, while the other one thereof is connected to the auxiliary capacitance 42 and also to the liquid crystal layer 4*b*. The liquid crystal layer 4*b* is sandwiched between a pixel electrode and counter electrode (not shown), with the pixel electrode being connected to the TFT 41 and the counter electrode being connected to a common electrode 4*c*, respectively. An electrode opposite to the TFT 41 in the auxiliary capacitance 42 is connected to a capacitance electrode 4*d*.

When the level of the scanning line signal 5*a* applied to the scanning line 50 transitions to a level not less than the gate threshold electric potential of the TFT 4, for example, the TFT 41 turns on, allowing electricity to conduct between the pixel electrode of the liquid crystal layer 4*b* and the data line 70. In this way, the capacitive component of the liquid crystal layer 4*b* and the auxiliary capacitance 42 are charged or discharged based on the level (electric potential) of the data line signal 7*a*. Then, preferably, while the TFT 41 is being turned on, the pixel electrode of the liquid crystal layer 4*b* reaches the same electric potential as that of the data line signal 7*a*. While the TFT 41 transitions to an off state when the level of the scanning line signal 5*a* transitions to less than the gate threshold value of the TFT 41, the electric potential difference between the electrodes sandwiching the liquid crystal layer 4*b* is substantially maintained by the capacitive component of the liquid crystal layer 4*b* and the auxiliary capacitance 42. As a result, in each one of the plurality of pixels 4, the liquid crystal layer 4*b* allows light to be transmitted at the transmittance based on the level of the data line signal 7*a* at the time the TFT 41 is on, causing a desired image to be displayed on the display panel 2.

As described previously, the display apparatus 1 comprises the signal correcting unit 6 and, in the present Embodiment, the signal correcting unit 6 corrects the scanning line clock signal 5*c* generated by the timing control unit 3. As it can be understood herein, a signal to be corrected by the signal correcting unit 6 is the scanning line clock signal 5*c* at the time when it has been generated by the clock generating unit 31 (the scanning line clock signal 5*c* at the time of outputting), that is, the scanning line clock signal 5*c* prior to the correction. The signal correcting unit 6 corrects the scanning line clock signal 5*c* such that time differences between a timing of one level transition of the scanning line clock signal 5*c* at the time of outputting thereof and a timing of a level transition of the scanning line signal 5*a* based on this one level transition substantially match one another among the scanning line signals 5*a* output by respective ones of the plurality of scanning line drive units 5.

For example, the signal correcting unit 6 corrects, for at least one of the plurality of scanning line drive units 5 (first scanning line drive unit), the scanning line clock signal 5*c* based on a shift time set for each of this at least one first scanning line drive unit. For example, the signal correcting unit 6 delays a timing of level transition of the scanning line clock signal 5*c* by the shift time set for the first scanning line drive unit, the timing of level transition of the scanning line clock signal 5*c* being a basis for a level transition of the scanning line signal 5*a* output by the above-mentioned first scanning line drive unit. Below, for each of the level transitions to be shifted (to be delayed) in the scanning line clock signal 5*c*, the timing before the shifting of each level transition (the original timing before being delayed) is also called "the reference transition timing".

As described previously, the signal correcting unit 6 can be configured using an internal circuit of an ASIC, etc., that can be a main constituting element of the timing control unit 3, or the signal correcting unit 6 can be provided separately from constituting elements of the timing control unit 3 using a general-purpose programmable logic device (PLD), etc. For example, programs for correcting are prepared that can be executed by an internal processor of the ASIC or the PLD, etc., and includes a series of instructions to correct the scanning line clock signal 5*c* using the shift times set for the respective scanning line drive units 5. The signal correcting unit 6 can be configured by writing the programs for correcting into an internal storage element of the ASIC or the PLD, etc.

As shown in FIG. 2, the display apparatus 1 further comprises a storage unit 6*a*. The storage unit 6*a* is included in the signal correcting unit 6. The storage unit 6*a* is a storage element, for example, which an ASIC, etc., making up the tinning control unit 3 comprises. The storage unit 6*a* can be a storage element such as a separate memory IC provided in the timing control unit 3, or can be an arbitrary storage element provided separately from the timing control unit 3. The storage unit 6*a* stores therein information on the shift time set for each of the at least one of the plurality of scanning line drive units 5 (first scanning line drive unit).

The storage unit 6*a* comprises, for example, a plurality of storage spaces associated with respective ones of the plurality of scanning line drive units 5 and in an individual storage space, the shift time set for the first scanning line drive unit with which the individual storage space is associated is stored. The storage unit 6*a* can comprise a lookup table (LUT) regarding the at least one first scanning line drive unit and the shift time. With reference to the LUT within the storage unit 6*a*, for example, the signal correcting unit 6 can obtain the shift time for each of the at least one first scanning line driving unit and can correct the scanning line clock signal 5*c* using the obtained shift time.

Figure 4:
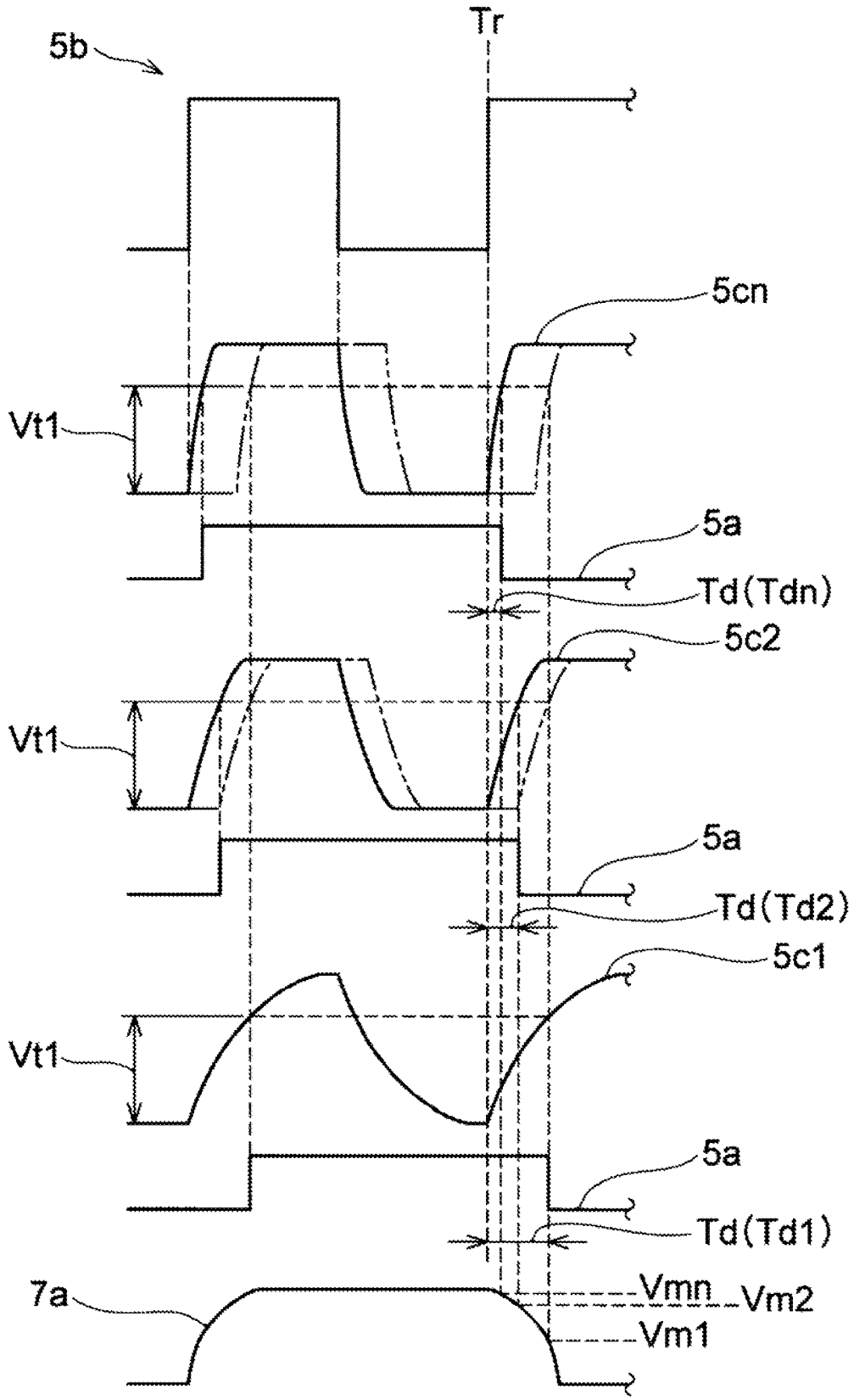
FIG. 4 shows exemplary waveforms of a scanning line clock signal according to one Embodiment of the present disclosure.

The significance of causing the time differences between a timing of a level transition of the scanning line clock signal 5*c* at the time of outputting and a timing of a level transition of the scanning line signal 5*a* based on the level transition of the scanning line clock signal 5*c* to substantially match one another among the scanning line signals 5*a* output by respective ones of the plurality of scanning line drive units 5 is described with reference to FIG. 4. FIG. 4 shows waveforms 5*c*1, 5*c*2, and 5*c*n of a scanning line clock signal actually seen at an input section (an input terminal) of each one of the plurality of scanning line drive units 5. Moreover, FIG. 4 shows a waveform 5*b* of the scanning line clock signal 5*c* which is the waveform at the time of outputting from the clock generating unit 31 (see FIG. 2) (the waveform at the time of outputting of the scanning line clock signal 5*c*), and is the waveform of the scanning line clock signal 5*c* prior to be corrected. Deformation occurs in the waveforms 5*c*1, 5*c*2, and 5*c*n of the scanning line clock signal 5*c* at the input section of each scanning line drive unit 5 relative to the waveform at the time of outputting of the scanning line clock signal 5*c*.

The waveform 5*c*1 is the waveform at an input section of a scanning line drive unit A (not shown) in the plurality of scanning line drive units 5. The scanning line drive unit A is a scanning line drive unit arranged farthest from an input end (below, this input end is also called "a scanning line clock input end") of a wiring on the display panel 2 to which the scanning line clock signal 5*c* is input. The waveform 5*c*2 is the waveform at an input section of a scanning line drive unit B (not shown) arranged nearer to the scanning line clock input end in comparison with the scanning line drive unit A. Then, the waveform 5*c*n is the waveform at an input section of a scanning line drive unit N (not shown) arranged nearest to the scanning line clock input end in the plurality of scanning line drive units 5. In this way, the waveforms of the scanning clock signal 5*c* can differ at the input section of each one of the plurality of scanning line drive units 5. This difference can occur, for example, due to the difference in impedance of the propagation path of the scanning line clock signal 5*c* for each one of the plurality of scanning line drive units 5 such as the scanning line drive units A, B, and N which are mutually different in distance thereto from the scanning line clock input end. Moreover, the waveform of the scanning line clock signal 5*c* at the input section of each one of the plurality of scanning line drive units 5 can mutually differ also due to the difference in input impedance between each of the scanning line drive units 5.

Immediately under each of the waveforms 5*c*1, 5*c*2, and 5*cn* in FIG. 4, the scanning line signals 5*a* are shown which are output from the respective scanning line drive units 5 into which the scanning line clock signal 5*c* having the waveform 5*c*1, 5*c*2, or 5*cn* is input. While the case of the scanning line drive units 5 simultaneously causing the level of the respective scanning line signals 5*a* to transition does not occur in practice, the three scanning line signals 5*a* are shown as being mutually synchronized such that the difference between the scanning line driving units 5 is easily understood.

As shown in FIG. 4, the level of each of the scanning line signals 5*a* transitions when the level (electric potential) of the scanning line clock signal 5*c* rises above (or falls below) a given threshold value Vt1 (for example, the gate threshold value of a transistor receiving the scanning line clock signal 5*c*). Therefore, in a case where the waveforms of the scanning clock signals 5*c* each actually input into each of the scanning line drive units 5 are mutually different, a time difference (delay time) Td between the reference transition timing Tr and the timing of level transition of the scanning line signal 5*a* ends up being different among the respective scanning line drive units 5. In such a case, each of the TFTs 41 (see FIG. 3) connected to each of the scanning line drive units 5 transitions state thereof at timings which are mutually different in the elapsed time from the reference transition timing Tr.

In a case that the voltage applied to the liquid crystal layer 4*b* (see FIG. 3) is constant within the range of the difference in the time difference Td with respect to the timing of transitioning to an off state of the TFT 41, the problem with respect to the difference in the time difference Td is unlikely to occur. However, as described previously, with an increase in the number of pixels and/or the frame rate, the time allowed to turn on the TFT 41 (for example, one period of the scanning line clock signal 5*c*) becomes shorter. Thus, it becomes more difficult for the level of the data line signal to reach a desired level during the time in which each of the TFTs 41 is on. Therefore, as shown in FIG. 4, the TFT 41 is kept on state until or immediately before or immediately after the level transition of the data line signal 7*a* is started for the next-row scanning line 50 (see FIG. 3). On the other hand, as shown in FIG. 4, the data line signal 7*a* can have a certain transition period in its own level transition. Therefore, when the level of the scanning line signal 5*a* transitions at the mutually different timing for each of the scanning line drive units 5 relative to the reference transition timing Tr, as shown in FIG. 4, some or all of the TFTs 41 can transition to an off state during the level transition period of the data line signal 7*a*. In that case, the voltage based on the level Vm1, Vm2, Vmn of mutually different magnitude in the data line signal 7*a* is held in the liquid crystal layer 4*b* (see FIG. 3) of the pixels 4 connected to the respectively different scanning line drive units 5. As a result, luminance unevenness occurs between specific rows of the pixels 4 arranged in a matrix. For example, display unevenness (so-called block separation) consisting of a plurality of belt-shaped areas, each one of which having mutually different luminance and/or hue along the direction orthogonal to the arrangement direction of the plurality of scanning line drive units 5.

Thus, in the present Embodiment, the signal correcting unit 6 (see FIG. 2) is provided to correct the scanning line clock signal 5*c* such that the time differences Td between a timing of a level transition of the scanning line clock signal 5*c* at the time of outputting and a timing of a level transition of the scanning line signal 5*a* based on the level transition of the scanning line clock signal 5*c* substantially match one another among the scanning line signals 5*a* output by respective ones of the plurality of scanning line drive units 5. The signal correcting unit 6 delays the timing of level transition of the scanning line clock signal 5*c* in accordance with each of the scanning line drive units 5 as the waveforms shown in chain double-dashed lines along with the waveforms 5*c*2, 5*cn* in FIG. 4, for example, to correct the scanning line clock signal 5*c*. In this way, the timing of level transition of the scanning line signal 5*a* in at least one of the plurality of scanning line drive units 5 (first scanning line drive unit can be delayed relative to the reference transition timing Tr. More specifically, the scanning line clock signal 5*c* can be corrected based on the shift time set for each of the first scanning line drive units to reduce the difference in the time difference Td between each of the scanning line drive units 5. As a result, the previously-mentioned display unevenness can be suppressed, or, preferably, such display unevenness can be eliminated.

As it can been understood from FIG. 4, in a case that an input property for the scanning line clock signal 5*c*, for example, the threshold value Vt1 differs between each of the scanning line drive units 5, regardless of the presence of distortion in the waveform of the scanning line clock signal 5*c*, the difference with respect to the previously-described time difference Td can occur between each of the scanning line drive units 5. In the present Embodiment, even in such a case, by setting a shift time individually for each of the scanning line drive units 5 based on the threshold value Vt1 of each of the scanning line drive units 5, the signal correcting unit 6 can correct the scanning line clock signal 5*c* based on the set shift time. Therefore, the difference with respect to the time difference Td between each of the scanning line drive units 5 can be reduced, making it possible to reduce the above-described display unevenness.

A method for determining the shift time by the signal correcting unit 6 is exemplified below. This example sets the time difference Td of the scanning line drive units A, B, and N (the time difference in a case that there is no correcting by the signal correcting unit 6) as Td1, Td2, Tdn, respectively, where Td1>Td2>Tdn. In such a case, the signal correcting unit 6 is configured to delay, for example, a timing of level transition, which is to be a basis for a level transition of the scanning line signal 5*a* output by the scanning line drive unit N, in the scanning line clock signal 5*c* by the shift time Tsn=(Td1−Tdn) relative to the reference transition timing Tr.

On the other hand, the signal correcting unit 6 may not correct the scanning line clock signal 5*c* for the scanning line drive unit A arranged farthest from the scanning line clock input end in the plurality of scanning line drive units 5. In other words, the signal correcting unit 6 may not delay the timing of level transition, which is to be a basis for a level transition of the scanning line signal 5*a* output by the first scanning line drive unit A, in the scanning line clock signal 5*c* relative to the reference transition timing Tr, so that zero can be set as the shift time for the scanning line drive unit A.

As for the other scanning line drive units such as the scanning line drive unit B, the respective shift times can be determined in a manner similar to that for the scanning line drive unit N. By setting the shift times determined in such a manner as described above for the respective scanning line drive units 5, it is possible to reduce the previously-described display unevenness.

Figure 6:
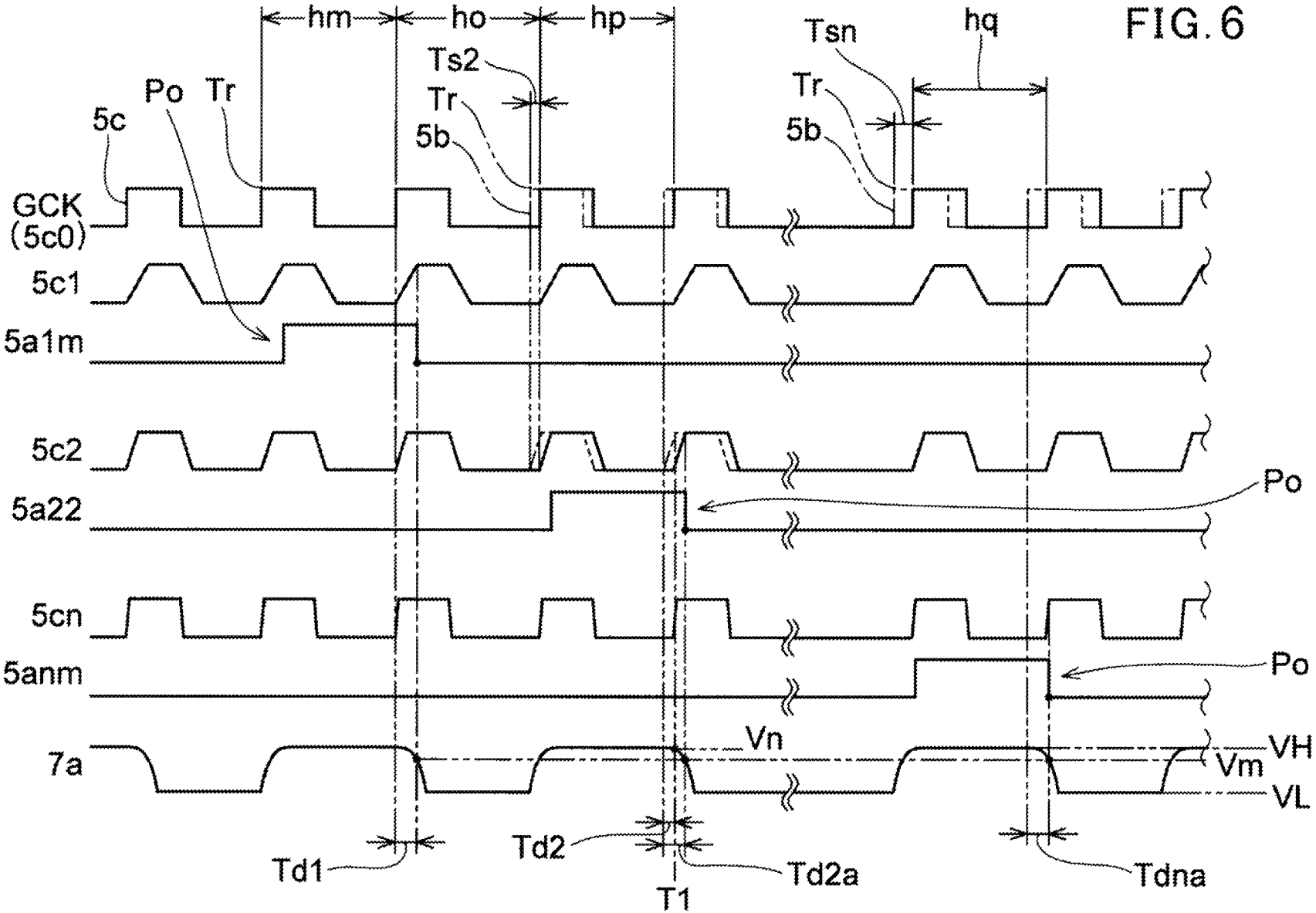
FIG. 6 shows a timing chart indicating an example of the waveform of each signal generated in the display apparatus according to one Embodiment of the present disclosure.

Correcting of the scanning line clock signal by the signal correcting unit 6 is described below in a more specific manner with reference to FIGS. 5A and 6. FIG. 5A shows a plurality of scanning line drive units 5 (scanning line drive units 501, 502, 50*n*) in the display apparatus 1 according to the present Embodiment, along with some of a plurality of scanning line drive circuits 51 (first, second, and m-th scanning line drive circuits 511, 512, 51*m*) included in each of the scanning line drive units 5. FIG. 6 shows an example of the waveform of each signal generated in the display apparatus 1 exemplified in FIG. 5A in a timing chart format.

As shown in FIG. 5A, the plurality of scanning line drive units 5 is arranged along one side 2*a* of the display panel 2 and is fixed to the edge along the one side 2*a* of the display panel 2. As in the example of FIG. 5A, for example, each of the plurality of scanning line drive circuits 51 included in each of the scanning line drive units 5 comprises a push-pull type output section comprising a pair of transistors, and a conductive wire connected to each of the output sections is connected to the scanning line 50 of the display panel 2. A general-purpose scanning line driver IC as described above can be used for the scanning line drive circuit 51.

The display panel 2 comprises a first wiring 8 being connected to each one of the plurality of scanning line drive units 5 to transmit the scanning line clock signal 5*c*. The first wiring 8 comprises an input end 8*a* to which the scanning line clock signal 5*c* generated by the timing control unit 3 (see FIG. 2) is applied. Moreover, the display panel 2 comprises a second wiring 82 to transmit a scanning start pulse (so-called gate start pulse (GSP)) sent from the timing control unit 3. In the example in FIG. 5A, one end opposite to an input end 82*a* of the second wiring 82 is connected to a scanning line drive unit 501. Thus, when the GSP is input from the timing control unit 3 into the display panel 2, the scanning line signal 5*a* including a pulse having the level to turn on the TFT 41 (see FIG. 3) (below also called merely "an on-pulse") within the display panel 2 is output from a first scanning line drive circuit 511 of the scanning line drive unit 501. Thereafter, the on-pulse is successively output from each of the scanning line drive circuits 51 up to an m-th scanning line drive circuit 51*m* of the scanning line drive unit 50*n* in synchronization with the scanning line clock signal 5*c*.

The first wiring 8 (and the second wiring 82) are formed using tungsten, molybdenum, titanium, aluminum, an alloy of copper and titanium, or an ITO (Indium-tin-oxide), for example. The first wiring 8 is preferably formed with a wiring pitch as narrow as possible from a viewpoint of narrowing of the bezel, for example. Therefore, the first wiring 8 can have a capacitive component and a conductor resistance of a certain magnitude.

Figure 5B:
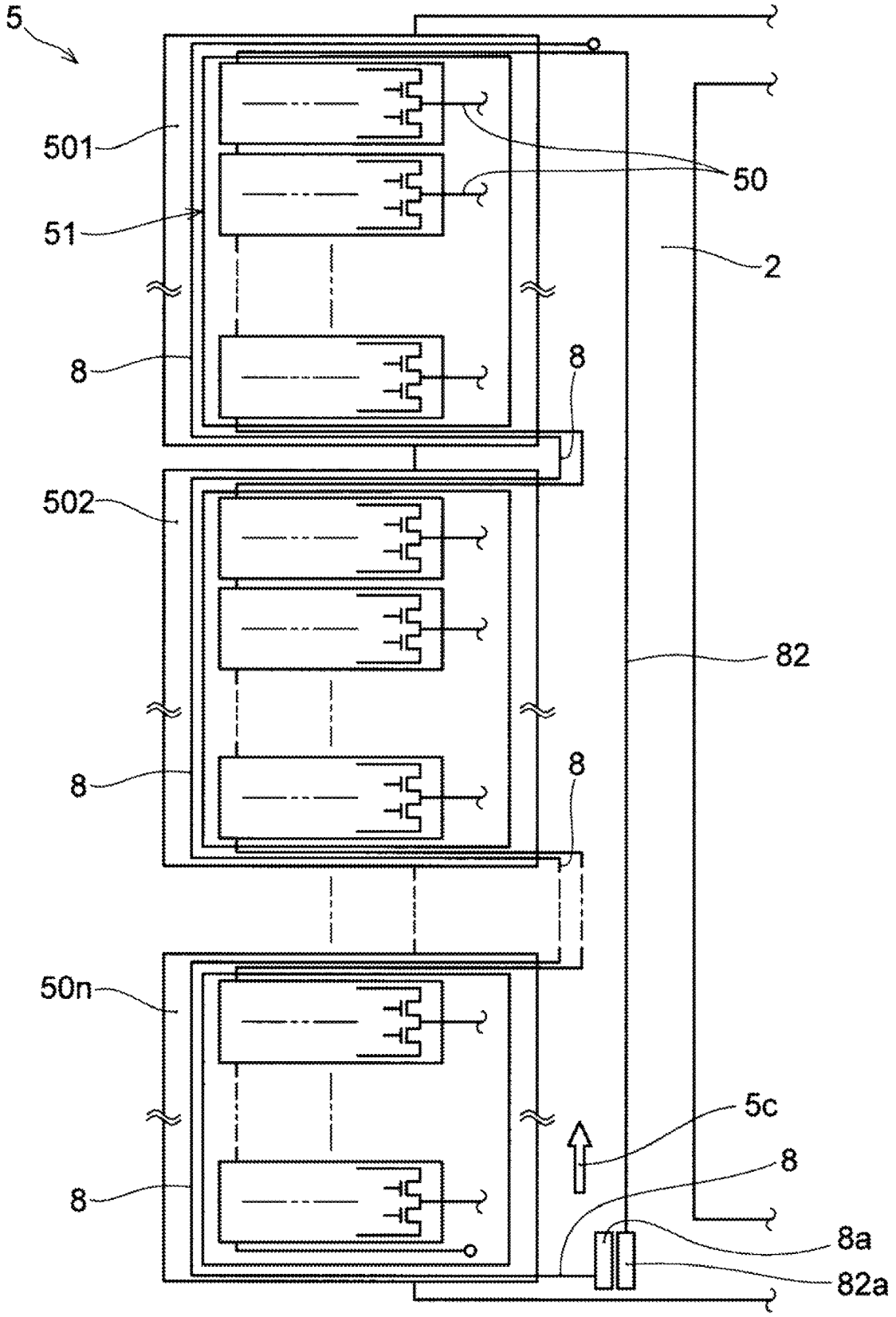
FIG. 5B shows another example of the plurality of scanning line drive units in the display apparatus according to one Embodiment of the present disclosure.
Figure 5C:
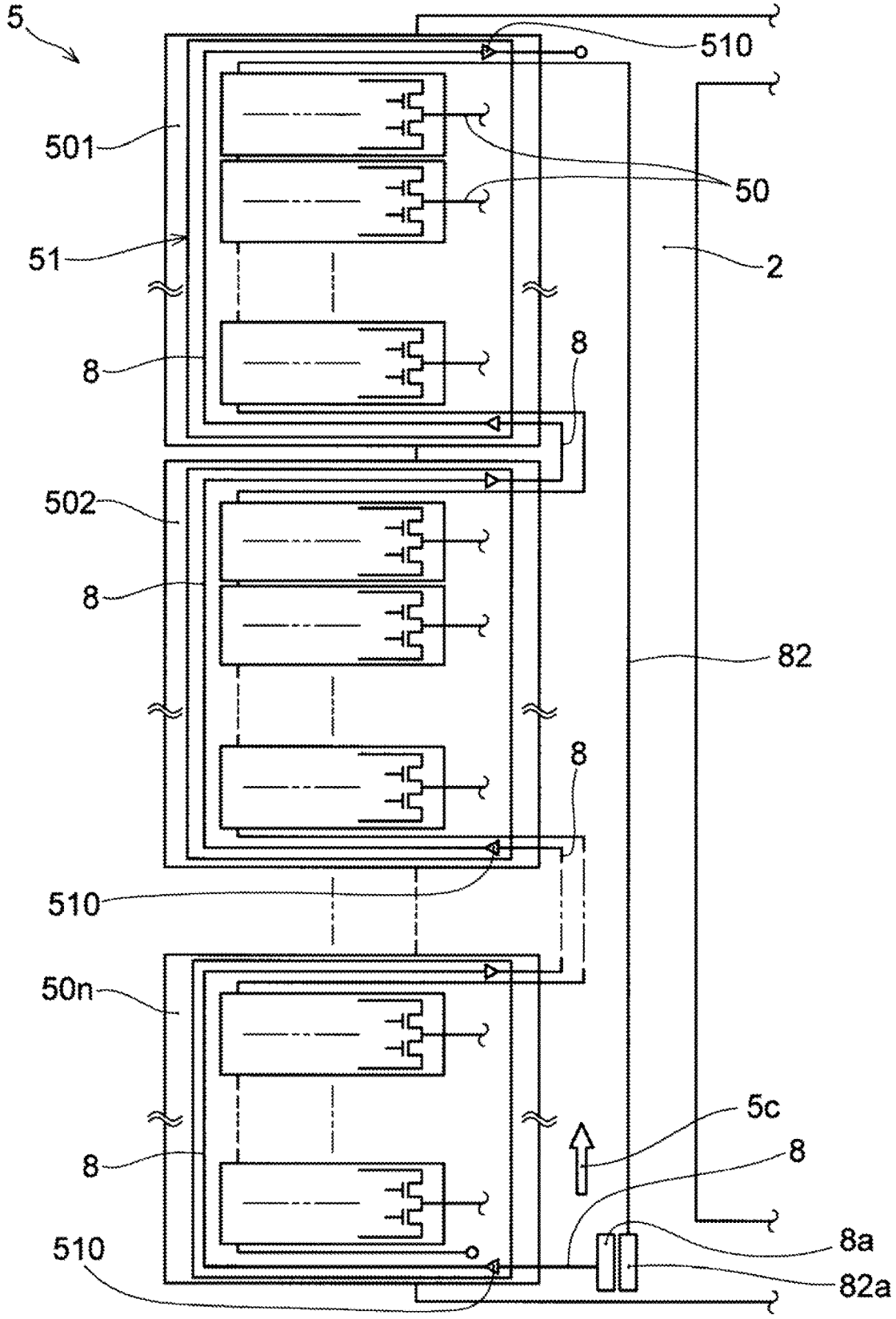
FIG. 5C shows yet another example of the plurality of scanning line drive units in the display apparatus according to one Embodiment of the present disclosure.

As shown in FIGS. 5B and 5C, the first wiring 8 can have a configuration different from that of the example in FIG. 5A. In FIGS. 5B and 5C, a plurality of scanning line drive circuits 51 is integrated into a semiconductor integrated circuit (a driver IC). Each of the scanning line drive units 5 has a chip on film (COF) structure comprising the carrier substrate 52 (see FIG. 1) and a plurality of scanning line drive circuits 51 integrated. The first wiring 8 extends to the scanning line drive unit 501 being farthest from the input end 8*a* via also the wiring pattern within the COF making up each of the scanning line drive units 5 in addition to the wiring pattern formed on the display panel 2. Moreover, in the example in FIG. 5C, the first wiring 8 extends to the scanning line drive unit 501 via also the wiring within the driver IC making up the plurality of scanning line drive circuits 51. In addition, in the example in FIG. 5C, the first wiring 8 also passes through a buffer element 510 made up of an operational amplifier, etc., in the driver IC making up the plurality of scanning line drive circuits 51. In FIGS. 5B and 5C, the configuration other than the scanning line drive circuit 51 and the first wiring 8 is the same as the configuration shown in FIG. 5A. Thus, for the same configuration, the same reference numerals as those in FIG. 5A are affixed, or the reference numerals are omitted as needed and the explanations thereof will be omitted.

In this way, the first wiring 8 can pass through a path formed in the driver IC, the carrier substrate of the COF, and the display panel 2 and having a capacitive component and a conductor resistance while it is connected to all of the scanning line drive units 5. Therefore, the scanning line clock signal 5*c* including a high frequency component is likely to be deformed while it propagates up to each of the scanning line drive units 5 through the first wiring 8 from the input end 8*a* and it is likely to get distorted in the waveform thereof. In addition, the degree of distortion of the waveform of the scanning line clock signal 5*c* is likely to differ between the scanning line drive units 5, each of which having a mutually different distance from the input end 8*a*.

For example, at the scanning line drive unit 501 farthest from the input end 8*a*, the waveform of the scanning line clock signal 5 input thereto is likely to get distorted more than that in the scanning line drive unit 5 from the scanning line drive unit 502 to the scanning line drive unit 50*n* which are nearer to the input end 8*a*. Such a difference in the waveform between each of the scanning line drive units 5 can result in display unevenness as described previously. However, in the present Embodiment, the signal correcting unit 6 (see FIG. 2) to correct the scanning line clock signal 5*c* is provided. Therefore, it is possible to avoid an occurrence of such display unevenness.

With reference to each of the waveforms shown in FIG. 6, correction of the scanning line clock signal 5*c* is further described. At the top stage indicated with "GCK" in FIG. 6, a waveform 5*c*0 of the scanning line clock signal 5*c* after being corrected by the signal correcting unit 6, the waveform 5*c*0 being at the output terminal of the timing control unit 3, is shown with a solid line. In addition, at this stage, with chain double-dashed lines, a waveform 5*b* of the scanning line clock signal 5*c* before being corrected is indicated, most of the waveform 5*b* being overlapped onto the waveform 5*c*0. Moreover, inn FIG. 6, at the stage immediately below GCK, a waveform 5*c*1 of the scanning line clock signal 5*c* at the input section of the scanning line drive unit 501 is shown. Similarly, waveforms 5*c*2 and 5*c*n of the scanning line clock signals 5*c* at the scanning line drive units 502 and 50*n* are shown, respectively. Moreover, at the stage below the waveform 5*c*1, a scanning line signal 5*a*1*m* output from the m-th scanning line drive circuit 51*m*, adjacent to the scanning line drive unit 502, in the scanning line drive unit 501. Moreover, at the stage immediately below the waveform 5*c*2, a scanning line signal 5*a*22 output from the second scanning line drive circuit 512 of the scanning line drive unit 502 is shown, and at the stage immediately below the waveform 5*cn*, a scanning line signal 5*anm* output from the m-th scanning line drive circuit 51*m* of the scanning line drive unit 50*n* is shown.

In FIG. 6, pulses in the waveforms 5*c*1, 5*c*2, and 5*cn* are simplified and drawn in a trapezoidal shape. Rise and fall of pulses in the waveforms 5*c*1, 5*c*2, and 5*cn* are inclined relative to the perpendicular direction. The magnitude of the inclination relative to the perpendicular direction represents the magnitude of distortion of the waveform of the scanning clock signal 5*c* at each of the scanning line drive units 501, 502, and 50*n*. The larger the inclination is, the larger the distortion of each of the waveforms is. In the example shown in FIG. 5A, the scanning line drive unit 501 is located farthest from the input end 8*a* of the first wiring 8, so that the waveform of the scanning line clock signal 5*c* at the scanning line drive unit 501 is likely to get distorted most. Therefore, the inclination of the waveform 5*c*1 is the largest. In FIG. 6, for ease of understanding, the scanning line signals 5*a*1*m*, 5*a*22, and 5*anm* are shown on the assumption that the threshold value Vt1 (see FIG. 4) of each of the scanning line drive units 5 for the scanning line clock signal 5*c* is a high level electric potential of the pulses in each of the waveforms 5*c*1, 5*c*2, and 5*cn*.

At the lowest stage in FIG. 6, a data line signal 7*a* to be applied to the arbitrary data line 70 is shown. The data line signal 7*a* exemplified in FIG. 6 has the level thereof reversed for each one scanning period between the electric potential VH and the electric potential VL. In other words, on the data line 70 to which the data line signal 7*a* shown in FIG. 6 has been applied, a pixel 4 having a luminance corresponding to the electric potential VH (for example, displaying white) and a pixel 4 having a luminance corresponding to the electric potential VL (for example, displaying black) line up alternately.

As described previously, when the GSP is input into the scanning line drive unit 501, an on-pulse Po is successively output from the first scanning line drive circuit 511 of the scanning line drive unit 501 in synchronization with the scanning line clock signal 5*c* for each one scanning period. As shown in FIG. 6, the timing of level transition of the scanning line clock signal 5*c* is not shifted between the first scanning period (not shown) in which the on-pulse Po is output from the scanning line drive unit 501, and the m-th scanning period hm. In other words, between the first scanning period and the m-th scanning period hm, the waveform 5*c*0 and the waveform 5*b* of the scanning line clock signal 5*b* before correcting overlap with each other. Therefore, in the m-th scanning period hm, the waveform 5*c*1 has the rise thereof starting at the rise time of the waveform 5*c*0 (waveform 5*b*) (the reference transition timing Tr).

Thereafter, the waveform 5*c*1 rises with the inclination according to the extent of its own deformation and, when the level of the waveform 5*c*1 reaches the threshold value of the scanning line drive unit 501, the scanning line signal 5*a*1*m* transitions from the low level to the high level. Then, when the waveform 5*c*1 reaches the threshold value of the scanning line drive unit 501 again after one scanning period, the scanning line signal 5*a*1*m* transitions from the high level to the low level. In this way, the on-pulse Po having a pulse width of substantially one scanning period is output. Then, based on a level Vm of the data line signal 7*a* when the on-pulse Po falls, or, in other words, based on the level Vm of the data line signal 7*a* when the TFT 41 (see FIG. 3) to gate of which the on-pulse Po is input transitions to an off state, the electric potential of the pixel electrode of the pixel 4 including that TFT 41 is held. A time difference Td1 occurs between the fall of the on-pulse Po of the scanning line signal 5*a*1*m* and the rise of the waveform 5*b* (waveform 5*c*0).

In the (m+1)-th scanning period ho in which the on-pulse Po is output from the scanning line drive unit 502 to the (2m)-th scanning period (not shown), the scanning line clock signal 5*c* is corrected based on a shift time Ts2 being set for the scanning line drive unit 502. More specifically, the timing of each level transition from level transition of the scanning line clock signal 5*c* resulting in completing the (m+1)-th scanning period ho (starting the (m+2)-th scanning period hp) to level transition of the scanning line clock signal 5*c* resulting in completing the (2m)-th scanning period. (starting the (2m+1)-th scanning period) is delayed by the shift time Ts2 relative to the reference transition timing Tr.

Here, in a case that the scanning line clock signal 5*c* is not corrected, rise of the waveform 5*c*2 is started at the reference transition timing Tr shown in the (m+2)-th scanning period hp in FIG. 6 with chain double-dashed lines. The inclination of rise and fall of the waveform 5*c*2 is smaller than the inclination of rise and fall of the waveform 5*c*1. Therefore, in a case that the scanning line clock signal 5*c* is not corrected, the on-pulse Po of the scanning line signal 5*a*22 falls at the timing T1 at which the time difference Td2 thereof becomes shorter than the time difference Td1 and the electric potential of the pixel electrode of the corresponding pixel 4 is held based on a level Vn of the data line signal 7*a* at the timing T1. In other words, each of the pixels 4 corresponding to the respective scanning periods can end up having a mutually different luminance even though the level of the data line signal 7*a* is the same at the electric potential VH between the m-th scanning period hm and the (m+2)-th scanning period hp, thus, display unevenness can occur.

However, in the present Embodiment, the scanning line clock signal 5*c* is corrected based on the shift time Ts2 set for the scanning line drive unit 502, so that, as shown in FIG. 6, in the (m+2)-th scanning period hp, the waveform 5*c*0 rises with a delay of the shift time Ts2 relative to the reference transition timing Tr and the waveform 5*c*2 also starts rising with a delay of the shift time Ts2 relative to the reference transition tinning Tr. Therefore, the on-pulse Po of the scanning line signal 5*a*22 falls at the timing with a delay by the shift time Ts2 relative to the timing T1, or, more specifically, it falls at the timing such that the time difference Td2*a* thereof (the time difference after correction of the scanning line clock signal 5*c*) amounts to a time difference substantially matching the time difference Td1. In other words, the shift time Ts2 is set such that the on-pulse Po of the scanning line signal 5*a*22 falls at the timing such that a time difference Td2*a* amounts to a time difference substantially matching the time difference Td1 or, in other words, at the timing at which the level of the data line signal 7 reaches Vm.

Although not shown, the scanning line clock signal 5*c* is corrected based on the shift time set for each of the scanning line drive units 5 in a manner similar to the (m+1)-th scanning period hp in any of the scanning periods thereafter. Then, as in the (m×n)-th scanning period hq shown in FIG. 6, in the scanning period in which the on-pulse Po is output from the scanning line drive unit 50*n*, the timing of level transition of the scanning line clock signal 5*c* is delayed by the shift time Tsn relative to the reference transition timing Tr. The scanning line drive unit 50*n* is arranged nearer to the input end 8*a* of the first wiring 8 than the scanning line drive unit 502, so that distortion of the waveform of the scanning line clock signal 5*c* at the scanning line drive unit 50*n* is smaller than that at the scanning line drive unit 502. Thus, the shift time Tsn is longer than the shift time Ts2. By using the shift time Tsn, the on-pulse Po falls at the timing in which a time difference Tdna thereof (the time difference after correction of the scanning line clock signal 5*c*) amounts to a time difference substantially matching the time difference Td1, therefore, it is possible to hold the electric potential of the pixel electrode of the pixel 4 based on the level Vm. In the same manner as the shift time Ts2, the shift time Tsn is set such that the on-pulse Po falls at the timing in which the time difference Tdna amounts to a time difference substantially matching the time difference Td1.

In this way, in the present Embodiment, using the shift time set for each of the first scanning line drive units from which the on-pulse Po is output in each of the scanning periods, the scanning line clock signal 5*c* in each scanning period is corrected. More specifically, the timing of level transition to be corrected in the scanning line clock signal 5*c* is delayed relative to the reference transition timing Tr.

As in the example in FIG. 5A, in a case that a plurality of first scanning line drive units (the scanning line drive units 5 in which the timing of level transition of the scanning line clock signal 5*c* being to be the basis for level transition of the scanning line signal 5*a* thereof is corrected, or the scanning line drive units 5 in which the timing of level transition of the scanning line signal 5*a* thereof is corrected) is existent, the shift time Tsn set for a first scanning line drive unit 50*n* being arranged nearest to the input end 8*a* of the first wiring 8 in the plurality of first scanning line drive units is preferably the longest of shift times set for respective ones of the plurality of first scanning line drive units. On the other hand, the scanning line drive unit 501 being arranged farthest from the input end 8*a* of the first wiring 8 in the plurality of scanning line drive units may not apply to the first scanning line drive unit. In other words, for the scanning line drive unit 501 being arranged farthest from the input end 8*a* of the first wiring 8, the shift time may not be set, or zero can be set as the shift time.

In this way, by setting a shift time being different for each one of the plurality of first scanning line drive units to which the scanning line clock signals 5*c* each having different deformation, it is possible to make the respective elapsed times from the reference transition timing Tr to the timing of being turned off substantially the same among the TFTs 41 connected to respective ones of the plurality of scanning line drive units 5. In the present Embodiment, the shift times for respective ones of the plurality of first scanning line drive units are set such that toward an elapsed time from the reference transition timing Tr to turning off of a TFT 41 which has the longest elapsed time, the elapsed time at which the other TFT 41 turns off approaches.

Unlike the example in FIG. 5A, even when the GSP is input into the scanning line drive unit 50*n*, the tinning of level transition of the scanning line clock signal 5*c* is preferably delayed the longest from the reference transition timing Tr in the scanning period in which the on-pulse Po is output from the scanning line driving unit 50*n*. When the GSP is input into the scanning line drive unit 50*n*, in displaying image of one frame, first the on-pulse Po is output from the scanning line drive unit 50*n* and finally the on-pulse Po is output from the scanning line drive unit 501. Thus, from the first scanning period to the m-th scanning period hm, the scanning line clock signal 5*c* is corrected based on the shift time Tsn set for the scanning line drive unit 50*n*. Even in this case, the shift time Tsn is preferably the longest of the shift times for the respective scanning line drive units 5. Thereafter, the scanning line clock signal 5*c* is preferably corrected based on the shift times set for the respective scanning line drive units 5 up to the scanning period in which the on-pulse Po is output from the scanning line drive unit 502. Even in this case, the scanning line clock signal 5*c* may not be corrected in the scanning period in which the on-pulse Po is output from the scanning line drive unit 501.

Moreover, in the present Embodiment, the lengths of the shift times set for respective ones of the plurality of scanning line drive units 5 are mutually different. And, when the scanning line drive unit 5 to output the on-pulse Po is switched, the shift time used in correcting the scanning line clock signal 5*c* is changed. Therefore, the sig correcting unit 6 is configured to change the shift time for each of given cycles for level transition of the scanning line clock signal 5*c*. Here, the number of the given cycles corresponds to the number of the two or more scanning lines connected to the respective scanning line drive units 5. The number of scanning lines 50 connected to the respective scanning line drive units 5 has been defined at the time of design of the display apparatus 1, so that it can be stored in the storage unit 6*a*, for example.

As shown in FIG. 6 and FIG. 4 which is previously referred to, the difference in the time difference Td for the reference transition timing Tr between each of the scanning line drive units 5 in a case that the signal correcting unit 6 is not provided is based on the difference in the inclination of rise and fall of the scanning line clock signal 5*c* input into each of the scanning line drive units 5, or, in other words, based on the difference in the transition speed of the signal level. Therefore, the shift time can be determined based on the transition speed of level transition of the scanning line clock signal 5*c* at a connecting portion with the first wiring 8 (see FIG. 5A) in the first scanning line drive unit. "The transition speed" is a ratio of the amount of level change relative to the time from the start of level transition of the scanning line clock signal 5*c* to its reaching to a given level, the ratio corresponding to the degree of signal deformation in the level transition period. While "a given level" can take an arbitrary level, "a given level" is preferably a threshold value of each of the scanning line drive units 5 for the scanning line clock signal 5*c*.

Figure 7:
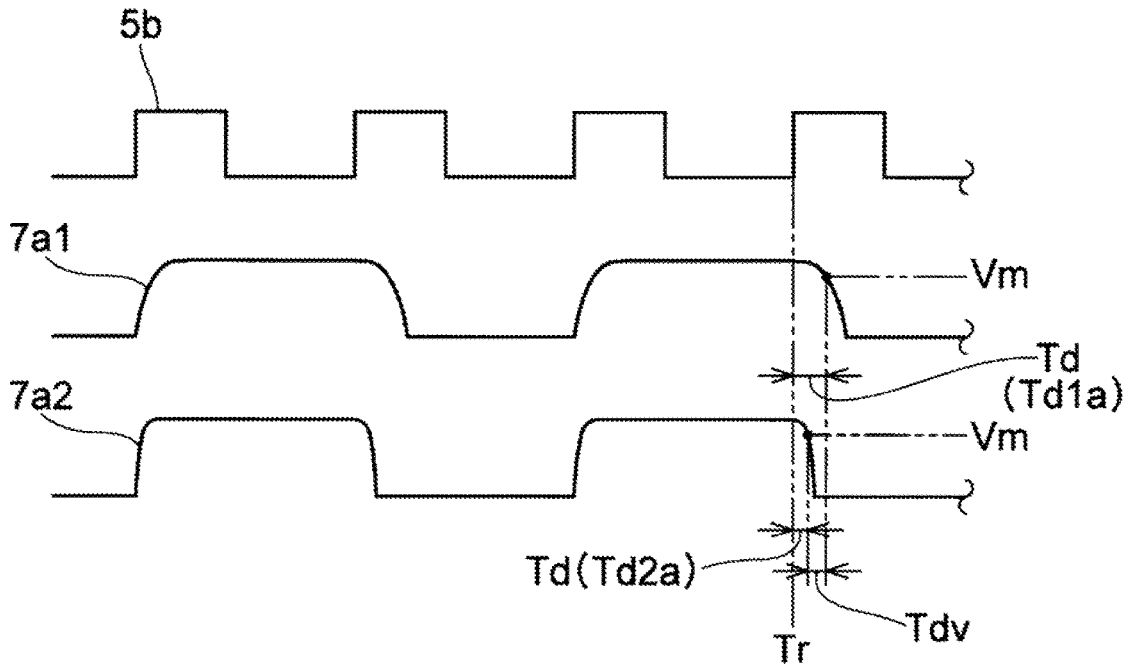
FIG. 7 shows an example of distortion of the waveform of a data line signal which may occur in one Embodiment of the present disclosure.

As shown in FIG. 4 and FIG. 6, the waveform of not only the scanning line clock signal 5*c*, but also the data line signal 7*a* can get distorted in accordance with the property of the data line 70, for example. Then, this distortion can increase as distance from the data line drive unit 7 (see FIG. 1) increases within the data line 70. FIG. 7 shows an example of a possible distortion of the waveform of the data line signal 7*a* in the display apparatus 1 of the present Embodiment, along with the waveform 5*b* of the scanning line clock signal 5*c* before correction. A waveform 7*a*1 in FIG. 7 shows the waveform of the data line signal 7*a* at the input section (for example, the source) of the TFT 41 connected to the scanning line drive unit 501 in FIG. 5A, while a waveform 7*a*2 therein shows the waveform at the input section of the TFT 41 connected to the scanning line drive unit 502. The TFT 41 connected to the scanning line drive unit 502 is nearer to the data line drive unit 7, so that deformation of the waveform 7*a*2 is smaller than deformation of the waveform 7*a*1.

In this case, when the scanning line clock signal 5*c* is corrected for the scanning line drive unit 502 taking into account only the deformation of the waveform of the scanning line clock signal 5*c* described previously such that the time difference Td1 at the scanning line drive unit 501 and the time difference after correction substantially match, the data line signal 7*a* in the TFT 41 connected to the scanning line drive unit 502 can become lower than the desired level Vm at the time of fall of the on-pulse Po as in the waveform 7*a*2 in FIG. 7. In order to deal with this, the signal correcting unit 6, another correcting unit, or the scanning line drive unit 5, for example, can perform, in addition to correction performed by the signal correcting unit 6 (correction to cause the time differences Td to substantially match among the scanning line signals 5*a* output by respective ones of the plurality of scanning line drive units 5) (a first correction), a further correction (a second correction) on the scanning line clock signal 5*c* or the scanning line signal 5*a* taking into account the difference in the deformation of the waveform of the data line signal 7*a* among the TFTs 41 connected to the respective scanning line drive units 5 so as to compensate for the difference in the deformation. For example, in FIG. 7, the second correction with respect to a time difference Tdv can be performed such that the time difference Td2*a* after correction at the scanning line drive unit 502 amounts to the time needed from the reference transition timing Tr to when the waveform 7*a*2 reaches the level Vm. The time difference Tdv is a time difference between the waveform 7*a*1 and the waveform 7*a*2 with respect to the timing to reach a certain level (Vm in FIG. 7). In a case that this second correction is performed, the time differences Td can eventually differ among the scanning line signals 5*a* output by respective ones of the plurality of scanning line drive units 5. However, it is preferable to substantially match the time differences Td between the scanning line signals 5*a* output to the two neighboring scanning lines 50 connected to the different scanning line drive units 5 respectively.

Figure 8:
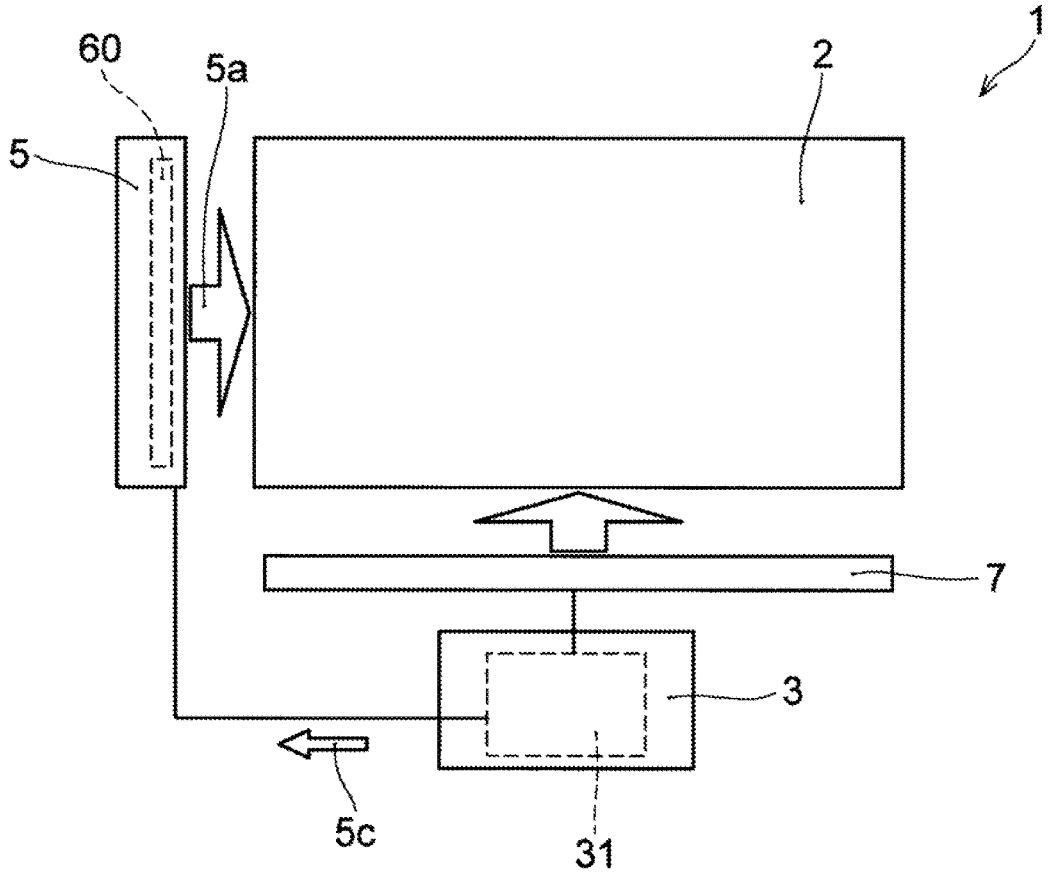
FIG. 8 schematically shows another exemplary aspect of the display apparatus according to one Embodiment of the present disclosure.

FIG. 8 schematically shows an example of another aspect of the display apparatus 1 according to the present Embodiment. The display apparatus 1 in the example in FIG. 8 differs from the example in FIG. 2 in that the display apparatus 1 in the example in FIG. 8 comprises a signal correcting unit 60 within the scanning line drive unit 5 and does not comprise the signal correcting unit 6 within the timing control unit 3. The signal correcting unit 60 corrects, not the scanning line clock signal 5*c*, but the scanning line signal 5*a* generated by at least one of the plurality of scanning line drive units 5, before the scanning line signal 5*a* is output from each of the scanning line drive units 5. In other words, the signal correcting unit 60 corrects the scanning line signal 5*a* generated by each of the scanning line drive units 5 such that the time differences Td between a timing of one level transition of the scanning line clock signal 5*c* at the time of outputting and a timing of a level transition of the scanning line signal 5*a* based on this one level transition substantially match one another among the scanning line signals 5*a* output by respective ones of the plurality of scanning line drive units 5. The signal correcting unit 60 corrects, for example, for at least one of the plurality of scanning line drive units 5 (first scanning line drive unit), the scanning line signal 5*a* based on the shift time set for each of this at least one first scanning line drive unit. For example, the signal correcting unit 60 delays the timing of level transition of the scanning line signal 5*a* output by this first scanning line drive unit by the shift time set for the first scanning drive unit relative to the scanning line signal 5*a* at the time of being generated by the first scanning line drive unit. The correction described herein corresponds to the above-described first correction. Therefore, the above-described second correction can be performed further in addition to the correction described herein.

Even in the example in FIG. 8, the shift time for the first scanning line drive unit can be set based on the concept previously described for the example in FIG. 2. The signal correcting unit 60 shown in FIG. 8 can comprise a line memory having a function of outputting, after a given time, the scanning line signal 5*a* input. The timing of the outputting thereof is controlled by the timing control unit 3 or the scanning line drive circuit 51, for example. The signal correcting unit 60 can store therein the shift time for the first scanning line drive unit.

Method for Driving Display Panel

Next, a method for driving display panel according to another Embodiment of the present disclosure is described with reference to FIG. 9 and FIGS. 1 to 8 again as needed. Various procedures, processes, controls, and applying various signals and voltage, etc., for driving the display panel 2 that are shown in the explanations of one Embodiment of the present disclosure described previously can be incorporated into the method for driving display panel according to the Embodiment described below even when they are not specifically indicated herein.

Figure 9:
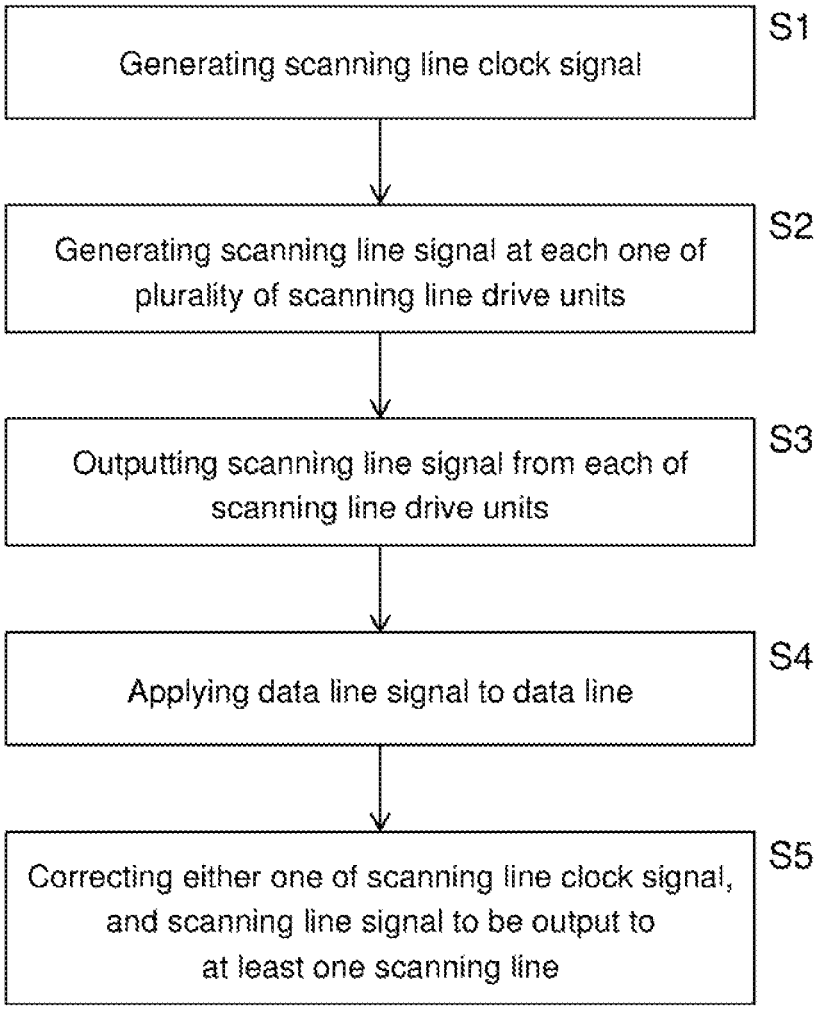
FIG. 9 shows a flowchart showing a method for driving display panel according to another Embodiment of the present disclosure.

As shown in FIG. 9 and FIGS. 1 to 3, 5A, 6, etc., the method for driving display panel according to the present Embodiment comprises: generating a scanning line clock signal 5*c* in which a signal level transition is repeated at a period corresponding to one scanning period of a display panel 2 comprising a plurality of pixels 4 arranged in a matrix (step S1 in FIG. 9); and generating a scanning line signal 5*a* to select a group of pixels 4 arranged in a row direction of the plurality of pixels 4, based on the scanning line clock signal 5*c* (step S2 in FIG. 9). The display panel 2 also comprises a plurality of scanning lines 50 being connected to the plurality of pixels 4 and a plurality of data lines 70 being connected to the plurality of pixels 4. The scanning line clock signal 5*c* is generated at the timing control unit 3, for example, and is sent to each one of a plurality of scanning line drive units 5. The scanning line signal 5*a* is generated at each one of the plurality of scanning line drive units 5 each one of which is connected to any two or more scanning lines 50 in the plurality of scanning lines 50. The method for driving display panel according to the present Embodiment further comprises: successively outputting the scanning line signal 5*a* to the plurality of scanning lines 50 from the plurality of scanning line drive units 5 (step S3 in FIG. 9); and applying a data line signal 7*a* to the plurality of data lines 70 (step S4 in FIG. 9). The data line signal 7*a* supplies a desired voltage (a voltage according to a gray scale value indicated by video data) to each of the plurality of pixels 4. The data line signal 7 is generated at the data line drive unit 7 and output to the plurality of data lines 70.

The method for driving display panel according to the present Embodiment further comprises: correcting either one of the scanning line clock signal 5*c* generated, and the scanning line signal 5*a* to be output to at least one scanning line 50 in the plurality of scanning lines 50 (step S5 in FIG. 9). In this step S5, either one of the scanning line clock signal 5*c* generated and the scanning line signal 5*a* is corrected such that time differences between a tinning of one level transition of the scanning line clock signal 5*c* and a timing of a level transition of the scanning line signal 5*a* based on the one level transition substantially match one another among the scanning line signals 5*a* output by respective ones of the plurality of scanning line drive units 5. The correction in step S5 can be embodied, using the signal correcting unit 6 shown in FIG. 2 or the signal correcting unit 60 shown in FIG. 8, for example, in the aspect shown in the description for the display apparatus according to the one Embodiment of the present disclosure as previously described.

As shown in the description for the previously-described display apparatus 1, the present Embodiment is also based on the idea to apply an on-pulse Po at a substantially constant interval to the display panel 2 even when the waveforms of the scanning line clock signal 5*c* differs between each of the scanning line drive units 5. Therefore, based on that idea, specific correcting conditions for either one of the scanning line clock signal 5*c* and the scanning line signal 5*a* are selected.

In step S5, the scanning line clock signal 5*c* or the scanning line signal 5*a* can be corrected, for at least one of the plurality of scanning line drive units 5 (first scanning line drive unit), based on the shift time set for each of this at least one first scanning unit. In other words, in a case that by correction in step S5, the time difference between the timing of the one level transition of the scanning line clock signal 5*c* and the timing of the level transition of the scanning line signal 5*a* output from the first scanning drive unit based on the one level transition is adjusted, the correction can be executed based on the shift time set for each of the first scanning line drive units. By executing the correction based on the shift time set for each of the scanning line drive units to be corrected (the first scanning line drive units), it is possible to execute the correction appropriately for each of the first scanning line drive units.

In a case that the correction in step S5 is executed based on the shift time set for each of the first scanning line drive units, the timing of level transition of the scanning line clock signal 5*c* to be the basis for the level transition of the scanning line signal 5*a* output by the first scanning line drive unit can be delayed by the shift time set for the first scanning line drive unit. In other words, the timing of one level transition to be delayed of the scanning line clock signal 5*c* can be delayed by the shift time set for each of the first scanning line drive units relative to the previously-described reference transition time.

The shift time can be set based on the speed of level transition of the scanning line clock signal 5*c* at each one of the plurality of scanning line drive units 5. In other words, it is set based on the extent of deformation of the scanning line clock signal 5*c* at the input section of each one of the plurality of scanning line drive units 5 or the extent of distortion of the waveform thereof.

The method for driving display panel according to the present Embodiment can be used for the display panel 2 comprising the first wiring 8 (see FIG. 5A) being connected to each one of the plurality of scanning line drive units 5 and comprising the input end 8*a* for the scanning line clock signal 5*c*. Moreover, the shift time can be set for each of two or more scanning line drive units (first scanning line drive units) in the plurality of scanning line drive units 5. In that case, correction in step S5 can be executed for the first scanning line drive unit being arranged nearest to the input end 8*a* in a plurality of first scanning line drive units, based on the longest shift time of shift times each set for the respective first scanning line drive units. In that case, the shift time may not be set for the scanning line drive unit 5 arranged farthest from the input end 8*a* in the plurality of scanning line drive units 5 (below called "the farthest scanning line drive unit"). Moreover, zero can be used as the shift time for the correction in step S5 for the farthest scanning line drive unit, or the correction in step S5 for the farthest scanning line drive unit can be omitted. In this way, the on-pulse Po (see FIG. 6) can be applied at a substantially constant interval in the display panel 2 comprising the plurality of scanning line drive units 5 having a difference with respect to the magnitude of deformation.

Correction in step S5 can comprise changing the shift time used for correcting the scanning line clock signal 5*c* or the scanning line signal 5*a*, for each of given cycles for level transition of the scanning line clock signal 5*c*. The number of the given cycles can correspond to the number of the two or more scanning lines to which respective ones of the plurality of scanning line drive units 5 are connected, and the given cycles can be the same as the number of the two or more scanning lines, for example.

SUMMARY (1) A display apparatus according to one embodiment of the present disclosure comprises: a display panel comprising a plurality of pixels arranged in a matrix, the plurality of pixels making up a display area, a plurality of scanning lines connected to a group of pixels arranged in a row direction of the plurality of pixels, and a plurality of data lines connected to a group of pixels arranged in a column direction of the plurality of pixels; a timing control unit to generate a scanning line clock signal in which a level transition is repeated from a first signal level to a second signal level at a period corresponding to one scanning period of the display panel; a plurality of scanning line drive units arranged along a part of the outer edge of the display area, wherein each one of the plurality of scanning line drive units successively outputs a scanning line signal to any two or more scanning lines in the plurality of scanning lines, the scanning line signal being a signal to select a group of pixels arranged in the row direction and being based on the scanning line clock signal; a data line drive unit to output, to the plurality of data lines, a data line signal for supplying a desired voltage to a group of pixels arranged in the row direction and selected by the scanning line signal; and a signal correcting unit to correct either one of the scanning line clock signal generated by the timing control unit, and the scanning line signal to be output to at least one scanning line in the plurality of scanning lines such that time differences between a timing of one level transition of the scanning line clock signal and a timing of a level transition of the scanning line signal based on the one level transition substantially match one another among the scanning line signals output by respective ones of the plurality of scanning line drive units.

The configuration of (1) makes it possible to reduce, even when there is a difference in a condition related to the scanning line clock signal in the plurality of scanning line drive units, the influence on an image displayed due to such a difference.

(2) In the display apparatus of aspect (1) mentioned above, the signal correcting unit can correct, for at least one first scanning line drive unit in the plurality of scanning line drive units, the scanning line clock signal or the scanning line signal based on a shift time set for each first scanning line drive unit. This aspect makes it possible to correct the scanning line clock signal or the scanning line signal more appropriately.

(3) In the display apparatus of aspect (2) mentioned above, the signal correcting unit can delay a timing of level transition of the scanning line clock signal by the shift time set for the first scanning line drive unit, the timing of level transition of the scanning line clock signal being to be a basis for a level transition of the scanning line signal output by the first scanning line drive unit. This aspect makes it possible to easily correct a scanning line clock signal by providing a signal correcting unit at the timing control unit, for example.

(4) In the display apparatus of aspect (2) mentioned above, the signal correcting unit can delay a timing of level transition of the scanning line signal, output by the first scanning line drive unit, by the shift time set for the first scanning line drive unit. This aspect makes it possible to avoid making the timing control unit complex.

(5) In the display apparatus of any one of aspects (2) to (4) mentioned above, the signal correcting unit can be configured to change the shift time for each of given cycles for level transition of the scanning line clock signal; and number of the given cycles can correspond to number of the two or more scanning lines. This aspect makes it possible to suitably correct the scanning line clock signal or the scanning line signal in accordance with each of the scanning line driving units.

(6) In the display apparatus of any one of aspects (2) to (5) mentioned above, the display panel can further comprise a first wiring to transmit the scanning line clock signal, the first wiring being connected to each of the plurality of scanning line drive units; and the shift time set for the first scanning line drive unit can be determined based on a transition speed of level transition of the scanning line clock signal at a connecting portion with the first wiring in the first scanning line drive unit. This aspect makes it possible to suitably correct the scanning line clock signal or the scanning line signal in accordance with the extent of deformation of the scanning clock signal at the plurality of scanning drive units.

(7) In the display apparatus of any one of aspects (2) to (6) mentioned above, the display panel can further comprise a first wiring to transmit the scanning line clock signal, the first wiring being connected to each of the plurality of scanning line drive units; the first wiring can comprise an input end for the scanning line clock signal; a plurality of the first scanning line drive units can be existent; and the shift time set for a first scanning line drive unit arranged nearest to the input end in the plurality of first scanning line drive units can be the longest of the shift times set for respective ones of the plurality of first scanning line drive units. This aspect makes it possible to turn off a TFT, at the suitable timing, which is connected to the scanning line drive unit to which a scanning line clock signal with relatively less deformation is input.

(8) In the display apparatus of any one of aspects (2) to (7) mentioned above, the display panel can further comprise a first wiring to transmit the scanning line clock signal, the first wiring being connected to each of the plurality of scanning line drive units; the first wiring can comprise an input end of the scanning line clock signal; and a scanning line drive unit arranged farthest from the input end in the plurality of scanning line drive units may not apply to the first scanning line drive unit. This aspect makes it possible to turn off a TFT, at the suitable timing, which is connected to the scanning line drive unit to which a scanning line clock signal with relatively greater deformation is input.

(9) The display apparatus of any one of aspects (2) to (8) mentioned above can further comprises a storage unit to store information on the shift time set for each first scanning line drive unit. This aspect allows easily obtaining the shift time with reference to the storage unit, thus making it possible to easily correct the scanning line clock signal or the scanning line signal.

(10) A method for driving display panel according to another embodiment of the present disclosure comprises: generating a scanning line clock signal in which a signal level transition is repeated at a period corresponding to one scanning period of a display panel, the display panel comprising a plurality of pixels arranged in a matrix, a plurality of scanning lines, and a plurality of data lines, the plurality of scanning lines and the plurality of data lines being connected to the plurality of pixels; generating a scanning line signal to select a group of pixels arranged in a row direction of the plurality of pixels, based on the scanning line clock signal, at each of a plurality of scanning line drive units connected to any two or more scanning lines in the plurality of scanning lines; successively outputting the scanning line signal to the plurality of scanning lines from the plurality of scanning line drive units; applying, to the plurality of data lines, a data line signal for supplying a desired voltage to each of the plurality of pixels; and correcting either one of the scanning line clock signal generated, and the scanning line signal to be output to at least one scanning line in the plurality of scanning lines such that time differences between a timing of one level transition of the scanning line clock signal and a timing of a level transition of the scanning line signal based on the one level transition substantially match one another among the scanning line signals output by respective ones of the plurality of scanning line drive units.

The configuration of (10) makes it possible to reduce, even when there is a difference in a condition related to the scanning line clock signal in the plurality of scanning line drive units, the influence on an image displayed due to such a difference

(11) In the method for driving display panel of aspect (10) mentioned above, the correcting the either one can comprise correcting, for at least one first scanning line drive unit in the plurality of scanning line drive units, the scanning line clock signal or the scanning line signal based on a shift time set for each first scanning line drive unit. This aspect makes it possible to correct the scanning line clock signal or the scanning line signal more appropriately.

(12) In the method for driving display panel of aspect (11) mentioned above, the correcting the either one can comprise delaying a timing of level transition of the scanning line clock signal by the shift time set for the first scanning line drive unit, the timing of level transition of the scanning line clock signal being to be basis for a level transition of the scanning line signal output by the first scanning line drive unit. This aspect makes it possible to easily correct a scanning line clock signal at the timing control unit, for example.

(13) In the method for driving display panel of aspect (11) or (12) mentioned above, the correcting the either one can comprise changing the shift time for each of given cycles for level transition of the scanning line clock signal, number of the given cycles corresponding to number of the two or more scanning lines. This aspect makes it possible to suitably correct the scanning line clock signal or the scanning line signal in accordance with each of the scanning line driving units.

(14) In the method for driving display panel of any one of aspects (11) to (13) mentioned above, the display panel can further comprise a first wiring being connected to each one of the plurality of scanning line drive units and comprising an input end for the scanning line clock signal, and the correcting the either one can comprise correcting the scanning line clock signal or the scanning line signal for a first scanning line drive unit being arranged nearest to the input end in a plurality of first scanning line drive units, based on a longest shift time of the shift times each set for respective first scanning line drive units. This aspect makes it possible to reduce variations in the interval of the on-pulses in the display panel comprising a plurality of scanning line drive units having a difference with respect to the magnitude of deformation of the scanning line clock signal.

What is claimed is:

1. A display apparatus comprising:

a display panel comprising a plurality of pixels arranged in a matrix, the plurality of pixels making up a display area, a plurality of scanning lines connected to a group of pixels arranged in a row direction of the plurality of pixels, and a plurality of data lines connected to a group of pixels arranged in a column direction of the plurality of pixels;

a timing control unit to generate a scanning line clock signal in which a level transition is repeated from a first signal level to a second signal level at a period corresponding to one scanning period of the display panel;

a plurality of scanning line drive units arranged along a part of the outer edge of the display area, each comprising a plurality of scanning line drive circuits, wherein each one of the plurality of scanning line drive circuits successively outputs a scanning line signal to a scanning line in the plurality of scanning lines, the scanning line signal being a signal to select a group of pixels arranged in the row direction and being based on the scanning line clock signal;

a data line drive unit to output, to the plurality of data lines, a data line signal for supplying a desired voltage to a group of pixels arranged in the row direction and selected by the scanning line signal; and a signal correcting unit configured to perform a first correction to correct a timing of a level transition of either one of the scanning line clock signal generated by the timing control unit, and the scanning line signal to be output to at least one scanning line in the plurality of scanning lines, wherein the signal correction unit comprises a delay unit to delay, for at least one first scanning line drive circuit in each of two or more of the plurality of scanning line drive units, the timing of the level transition of the scanning line clock signal or the scanning line signal based on a shift time set for each first scanning line drive unit comprising the first scanning line drive circuit, and the shift time is predetermined such that time differences between a timing of one level transition of the scanning line clock signal before performance of the first correction and a timing of a level transition of the scanning line signal based on the one level transition of the scanning line clock signal after the performance of the first correction are substantially the same among the scanning line signals output by respective ones of the scanning line drive circuits in each of the plurality of scanning line drive units.

2. The display apparatus according to claim 1, wherein in the first correction, the delay unit delays, by the shift time set for the first scanning line drive unit, a timing of the level transition of the scanning line clock signal to be a basis for a level transition of the scanning line signal output by the first scanning line drive unit.

3. The display apparatus according to claim 1, wherein in the first correction, the delay unit delays a timing of the level transition of the scanning line signal being generated by the first scanning line drive unit by the shift time set for the first scanning line drive unit before the scanning line signal is output from the first scanning line drive unit.

4. The display apparatus according to claim 1, wherein the signal correcting unit is configured to change the shift time for each of given cycles for the level transition of the scanning line clock signal; and a number of the given cycles corresponds to a number of the scanning lines.

5. The display apparatus according to claim 1, wherein the display panel further comprises a first wiring to transmit the scanning line clock signal, the first wiring being connected to each of the plurality of scanning line drive units; and the shift time set for the first scanning line drive unit is determined based on a transition speed of the level transition of the scanning line clock signal at a connecting portion with the first wiring in the first scanning line drive unit.

6. The display apparatus according to claim 1, wherein the display panel further comprises a first wiring to transmit the scanning line clock signal, the first wiring being connected to each of the plurality of scanning line drive units;

the first wiring comprises an input end for the scanning line clock signal;

a plurality of the first scanning line drive units exists; and the shift time set for a first scanning line drive unit arranged nearest to the input end in the plurality of first scanning line drive units is the longest of the shift times set for respective ones of the plurality of first scanning line drive units.

7. The display apparatus according to claim 1, wherein the display panel further comprises a first wiring to transmit the scanning line clock signal, the first wiring being connected to each of the plurality of scanning line drive units;

the first wiring comprises an input end of the scanning line clock signal; and the signal correcting unit is configured not to perform the first correction for a scanning line drive unit arranged farthest from the input end in the plurality of scanning line drive units.

8. The display apparatus according to claim 1, the display apparatus further comprising a storage unit to store information on the shift time set for each first scanning line drive unit.

9. A method for driving a display panel, the method comprising:

generating a scanning line clock signal in which a signal level transition is repeated at a period corresponding to one scanning period of a display panel, the display panel comprising a plurality of pixels arranged in a matrix, a plurality of scanning lines, and a plurality of data lines, the plurality of scanning lines and the plurality of data lines being connected to the plurality of pixels;

generating a scanning line signal to select a group of pixels arranged in a row direction of the plurality of pixels, based on the scanning line clock signal, at each of a plurality of scanning line drive units each comprising a plurality of scanning line drive circuits each connected to a scanning line in the plurality of scanning lines;

successively outputting the scanning line signal to the plurality of scanning lines from the plurality of scanning line drive units;

applying, to the plurality of data lines, a data line signal for supplying a desired voltage to each of the plurality of pixels; and performing a first correction to correct a timing of a level transition of either one of the scanning line clock signal generated, and the scanning line signal to be output to at least one scanning line in the plurality of scanning lines, wherein performing the first correction comprises a delaying, for at least one first scanning line drive circuit in each of two or more of the plurality of scanning line drive units, the timing of the level transition of the scanning line clock signal or the scanning line signal based on a shift time set for each first scanning line drive unit comprising the first scanning line drive circuit, wherein the shift time is predetermined such that time differences between a timing of one level transition of the scanning line clock signal before performance of the first correction and a timing of a level transition of the scanning line signal based on the one level transition of the scanning line clock signal after the performance of the first correction are substantially the same among the scanning line signals output by respective ones of the scanning line drive circuits in each of the plurality of scanning line drive units.

10. The method for driving a display panel according to claim 9, wherein the performing the first correction comprises delaying, by the shift time set for the first scanning line drive unit, a timing of the level transition of the scanning line clock signal to be a basis for a level transition of the scanning line signal output by the first scanning line drive unit.

11. The method for driving a display panel according to claim 9, wherein the performing the first correction comprises changing the shift time for each of given cycles for the level transition of the scanning line clock signal, a number of the given cycles corresponding to a number of the scanning lines.

12. The method for driving a display panel according to claim 9, wherein the display panel further comprises a first wiring being connected to each one of the plurality of scanning line drive units and comprising an input end for the scanning line clock signal, and the performing the first correction comprises correcting the scanning line clock signal or the scanning line signal for a first scanning line drive unit being arranged nearest to the input end in a plurality of first scanning line drive units, based on a longest shift time of the shift times each set for respective first scanning line drive units.

* * * * *